US007059429B2

(12) United States Patent
Taylor et al.

(10) Patent No.: US 7,059,429 B2
(45) Date of Patent: Jun. 13, 2006

(54) DRILLING ASSEMBLY AND METHOD

(75) Inventors: Bruce L. Taylor, Spring, TX (US); Richard A. Nichols, Spring, TX (US); Larry G. Palmer, Spring, TX (US); Marvin Gregory, Spring, TX (US)

(73) Assignee: Strataloc Technology Products, LLC, Spring, TX (US)

( * ) Notice: Subject to any disclaimer, the term of this patent is extended or adjusted under 35 U.S.C. 154(b) by 98 days.

(21) Appl. No.: 10/761,892

(22) Filed: Jan. 21, 2004

(65) Prior Publication Data

US 2004/0149492 A1 Aug. 5, 2004

Related U.S. Application Data

(60) Provisional application No. 60/442,737, filed on Jan. 27, 2003.

(51) Int. Cl.
*E21B 17/16* (2006.01)

(52) U.S. Cl. ..... 175/57; 175/320

(58) Field of Classification Search ..... 175/57, 175/320; 285/123.1, 123.5
See application file for complete search history.

(56) References Cited

U.S. PATENT DOCUMENTS

| | | | | |
|---|---|---|---|---|
| 1,792,941 | A | 2/1931 | Stevenson | |
| 2,126,075 | A | 8/1938 | Wright | |
| 2,814,462 | A | 11/1957 | De Jarnett | |
| 2,958,512 | A * | 11/1960 | Humphrey | 403/42 |
| 3,047,313 | A * | 7/1962 | Bruce | 285/47 |
| 3,062,303 | A | 11/1962 | Schultz | |
| 3,167,137 | A * | 1/1965 | Humphrey | 175/320 |
| 3,195,927 | A | 7/1965 | Kimbrell | |
| 3,232,638 | A | 2/1966 | Hollander | |
| 3,572,771 | A | 3/1971 | Redwine | |
| 3,706,348 | A | 12/1972 | Murphey, Jr. | |
| 3,955,835 | A | 5/1976 | Farrington | |
| 4,278,138 | A | 7/1981 | Rowley et al. | |
| 4,310,059 | A * | 1/1982 | Moore | 175/320 |
| 4,460,202 | A | 7/1984 | Chance et al. | |
| 4,760,889 | A | 8/1988 | Dudman | |
| 4,771,811 | A | 9/1988 | DeCell et al. | |
| 4,776,436 | A | 10/1988 | Nenkov et al. | |
| 4,905,776 | A | 3/1990 | Beynet et al. | |
| 6,145,602 | A | 11/2000 | Kutinsky | |
| 6,186,249 | B1 | 2/2001 | Bjornstad | |
| 6,230,822 | B1 | 5/2001 | Sullivan et al. | |
| 2002/0157895 | A1 | 10/2002 | Dubinsky et al. | |

OTHER PUBLICATIONS

Chen et al, "Wellbore Design: How long bits improve wellbore micro-tortuosity in ERD operations", *Offshore Magazine*, Aug., 2001.

Finger et al, "Development of a System for Diagnostic-While-Drilling (DWD)", *Society of Petroleum Engineers*, pp. 1-9, Feb., 2003.

Mansure et al, "Interpretation of Diagnostics-While-Drilling Data", *Society of Petroleum Engineers*, pp. 1-13, Oct., 2003.

* cited by examiner

*Primary Examiner*—William Neuder
(74) *Attorney, Agent, or Firm*—Kenneth L. Nash

(57) ABSTRACT

The present invention provides a drilling assembly and method that is especially useful for a bottom hole drilling assembly for drilling a borehole through an earth formation. In one embodiment, the drilling assembly is preferably comprised of a tungsten alloy which is sufficiently plastic to be able to withstand the bending, torsional, and compressive stresses which occur in a bottom hole drilling assembly. The tungsten alloy weight section may be axially moveable with respect to an outer tubular and when mounted within the bottom hole assembly, acts to place the outer tubular in tension to provide a stiffer bottom hole assembly.

45 Claims, 17 Drawing Sheets

DRILLING ASSEMBLY AND METHOD

The benefit of U.S. Provisional Patent Application No. 60/442,737, filed Jan. 27, 2003, is hereby claimed, and is hereby incorporated by reference.

TECHNICAL FIELD

The present invention relates generally to drilling wellbores for oil, gas, and the like. More particularly, the present invention relates to assemblies and methods for improved drill bit and drill string performance.

BACKGROUND ART

For many reasons, it is desirable to drill a straighter hole with reduced spiraling effects along the desired drilling path and with fewer washed out sections. For instance, it has been found that tortuosity, or spiraling effects frequently produced in the wellbore during drilling, are associated with degraded bit performance, bit whirl, an increased number of drill string trips, decreased reliability of MWD (measurement while drilling) and LWD (logging while drilling) due to the vibrations generally associated therewith, increased likelihood of losing equipment in the hole, increased circulation and mud problems due to the troughs along the spiraled wellbore, increased stabilizer wear, decreased control of the direction of drilling, degraded logging tool response due to hole variations including washouts and invasion, decreased cementing reliability due to the presence of one or more elongated troughs, clearance problems for gravel packing screens, decreased ROP (rate or speed of drilling penetration), and many other problems.

When drilling wells, it is highly desirable to drill the well as quickly as possible to limit the costs. It has been estimated that doubling the present day rate of drilling would result in cost savings to the oil industry of from two hundred to six hundred million dollars per year. This estimate may be conservative.

During the drilling of a well, considerable time is lost due to the need to trip the drill string. The drill string is removed from the wellbore for any of various reasons, e.g., to replace the drill bit. Reducing the number of drill string trips, especially in deep wells where removal and replacement of the drilling string takes considerable time, would greatly reduce drilling rig daily rental costs.

While the design of drill bits has often been the chief focus in the prior art to reduce many of the problems discussed above, some efforts have been made to improve other aspects of the bottom hole assembly. The typical bottom hole assembly includes a plurality of heavy weight drill collars. The typical steel heavy weight collars are relatively inexpensive and durable. However, due to their size and construction, prior art weight collars are unbalanced to some degree and tend to introduce variations. Moreover, even if they were perfectly balanced, the heavy weight collars have a buckling point and tend to bend up to this point during the drilling process. The result of inbalanced heavy weight collars and the bending of the overall downhole assembly produces a flywheel effect with an imbalance therein that may easily cause the drill bit to whirl, vibrate, and/or lose contact with the wellbore face in the desired drilling direction.

Efforts have also been made to make heavier drilling collars. For instance, it has been attempted to increase the diameter of steel drill collars to provide increased weight adjacent the drill bit. However, this then decreases the annular space between the higher diameter steel drill collars and the wall of the bore hole. The decrease in annular space creates a significant washout of the hole due to the necessarily higher velocity mud flow through a smaller annulus, especially in uncompacted formations.

Other attempts to increase the weight of the downhole assembly include the use of high density materials such as sintered tungsten and depleted uranium. However, significant problems have been encountered in mounting the high density sintered tungsten or depleted uranium due to the brittle nature thereof which has resulted in shortened life spans for such drilling collars. In one embodiment discussed in more detail in the below-listed prior art patents, threads are cut into the brittle heavy weight material itself. These threads are apparently highly subject to failure. In another embodiment, attempts are made to limit particular types of drilling stresses applied to the high density material. In this design, a thick steel jacket is utilized to attempt to absorb torsional, bending stresses, and other stresses while permitting compressive stress to be applied to the high density material which the brittle high density material is able to withstand. However, due to the compression mounting of the brittle sintered tungsten weight section to the surrounding thick steel jacket, the torsional and bending stresses are inevitably applied to the brittle sintered tungsten. Therefore, it appears that early failure is also likely for this design. The thick steel jacket also significantly limits the volume of high density material that can be utilized. The oil and gas drilling industry has long sought and continues to seek solutions to the above problems.

The following patents describe in more detail previous attempts made in the prior art to address the above problems:

U.S. Pat. No. 4,278,138, issued Jul. 14, 1981, to Rowley et al., discloses a composite drill collar for drilling bore holes in earth formations including a structural steel outer jacket having a lower end secured to a lower coupling connectable to a drill bit and an upper end secured to an upper coupling connectable to an adjacent drill collar thereabove. An annular heavy metal core of sintered tungsten is disposed in the jacket and is held in compression therein by preloading the lower and upper couplings against the ends of the core, which places the jacket in tension, causing the jacket to contract and grip the periphery of the core. The structural steel jacket has a thick wall to carry the bending, torsion, compression, tension and impact loads encountered in the drilling operation, so that such loads are not carried through the core, which has the purpose of increasing the overall density and mass of the composite drill collar, lessening considerably the tendency for a deviated well bore to be produced.

U.S. Pat. No. 1,792,941, issued Feb. 17, 1931, to E. E. Stevenson, discloses a pump barrel comprising a jacket having internal threads formed in the ends, and a centralizing recess at the inner ends of the internal threads; an intermediate liner in the jacket which is smaller in external diameter than the internal diameter of the jacket; end liners in the ends of the jacket which engage the intermediate liner and are of smaller external diameter than the internal diameter of the jacket; centralizing shoulders formed on the end liners, and rested in the centralizing recesses for centralizing the liners; and end collars screwed into the internal threads for clamping the liners together, the collars having inner end faces perpendicular to the axis of the liners.

U.S. Pat. No. 2,126,075, issued Aug. 9, 1938, to J. C. Wright, discloses a drill collar for use in a rotary drilling string including a body to be connected in the string and having sufficient strength for the transmission of the forces to which the string is subjected, a tubular part around the body, coupling means on the upper end of the part for connecting with a washover pipe whereby the part is adapted to operate as a continuation of the washover pipe, and means removably connecting the outer part with the body.

U.S. Pat. No. 2,814,462, issued Nov. 26, 1957, to F. D. De Jarnett, discloses a drill collar for connection between upper and lower portions of a drill column, upper and lower portions extending upwardly to a rotary table and downwardly to a drill bit, respectively, the drill collar both providing weight for downward pressure on the drill bit and for minimizing the transmission of vibration and shock forces from the drill bit to the drill column, the drill collar comprising: inner tube means having a longitudinal flow passage for communication with the drill column, upper coupling means fixed to the upper end of the inner tube means and adapted for connection with the lower end of the upper portion of the drill column, lower coupling means fixed to the lower end of the inner tube means and adapted for connection with the upper end of the lower portion of the drill column, outer tubular means having an upper end also connected to the upper coupling means and having a lower end connected to the lower coupling means, the outer tubular means surrounding at least a portion of the inner tube means and being spaced a predetermined distance therefrom to form a chamber therewith, a passageway extending from the exterior into the interior of the chamber, the chamber containing a selected medium comprising at least a liquid, the liquid only partially filling the chamber, mans to provide a liquid-tight seal for the chamber including means to seal the passageway, whereby vibratory and shock forces transmitted to the coupling means will be at least in part transmitted to the medium, the turbulence of the liquid created by the flow thereof in the chamber thereby dissipating at least some of the energy of the vibratory and shock forces.

U.S. Pat. No. 2,958,512, issued Nov. 1, 1960, to H. C. Humphrey, discloses a drill collar of composite construction comprising threaded end sections and inner and outer pipe members joined thereto in concentrically spaced relationship to each other thereby defining an annular chamber therewith, the pipe members being equal to and not greater than standard size drill pipe with conventional diametral dimensions, the drill collar being adapted to be attached to a drill string having the same outer diametral dimension, each of the threaded end sections having the same outer diametral dimensions as the outer pipe member and having an axial passageway with the same inner diametral dimension as that of the inner pipe member, and a metallic material completely occupying the annular chamber and having a higher specific gravity than the pipe members and the end sections and with comparable tensile strength to provide a drill collar of substantially the same or greater weight and of lesser outer diametral dimensions in comparison with a conventional integral drill collar, the metallic material comprising an alloy of lead having a specific gravity ranging from 9.4 to 11.3.

U.S. Pat. No. 3,047,313, issued Jul. 31, 1962, to G. H. Bruce, discloses a drill collar for use in a drill string which comprises inner and outer spaced apart tubular wall members, cellular reinforcing means between and bondedly attached and secured at least to a wall members throughout the length thereof, the cellular reinforcing means forming a plurality of cells in and throughout the length and width of the space with passageways in the cellular reinforcing means into each cell, the inner of the wall members providing an unobstructed bore for passage of fluid, means attached to each end of the wall members for connecting the drill collar into a drill string, and metal weighting means having a specific gravity greater than 8.0 in and filling the cells whereby a heavy drill collar and a pendulum effect to the drill string are provided, the cellular reinforcing means being formed of a high melting point metal substantially chemically inert to and unattacked by the metal weighting means received into the cells in a liquid state.

U.S. Pat. No. 3,062,303, issued Nov. 6, 1962, to W. E. Schultz, discloses a method of changing during drilling operations the direction of a well which is inclined to the vertical, the method comprising inserting and rotatably mounting in a drill string above a drill bit an eccentrically weighted tool adapted to expand an element radially against the wall of the well, placing the element in pressure communication with the interior of the drill string, lowering the drill string and tool to substantially the bottom of the well, reciprocating the drill string from the surface with sufficient force to jar the tool causing it to turn about the drill string axis to a desired position, applying fluid pressure through the drill string to expand radially against the well wall the expandible element of the rotatably mounted tool to force the tool to one side of the well, and subsequently rotating the drill string and bit within the well to resume drilling operations.

U.S. Pat. No. 3,167,137, issued Jan. 26, 1965, to H. C. Humphrey, discloses in combination, in a drill collar of composite construction subject to rotation, end sections and inner and outer pipe members joined thereto in concentrically spaced relationship to each other thereby defining an annular chamber therewith, the drill collar being adapted to be attached to a rotatable drill pipe string having the same outer diametral dimensions, each of the end sections having the same outer diametral dimension as the outer pipe member and having a passageway in coaxial communication with and with a diameter equal to the inner diameter of the inner pipe member, a metallic material completely occupying the annular chamber and having a higher specific gravity than the pipe members and the end sections to provide a drill collar of substantially the same or greater weight and of lesser outer diametral dimension in comparison with a conventional integral drill collar, the metallic material being selected from the group consisting of lead and an alloy of lead having a specific gravity ranging from 9.4 to 11.3, and a plurality of resilient metallic members fixedly fastened to and spaced along the length of one of the pipe members within the annular chamber, the metallic members projecting equidistantly from one of the pipe member into contact with the other of the pipe members with respect to each other, the metallic members being imbedded in the metallic material to serve as anchors therefor.

U.S. Pat. No. 3,195,927, issued Jul. 20, 1965, to W. B. Kimbrell, discloses a weight pipe comprising an outer member prestressed in axial tension and having an upper end and a lower end, an inner tube prestressed in axial compression disposed in the outer member and having an upper end and a lower end, the upper end of the inner tube being press fitted with an interference fit within the upper end of the outer member forming an overload releasable joint between the upper ends, the lower end of the inner tube being press fitted within the lower end of the outer member forming a joint between the upper ends of the inner tube and outer member requiring less overload torque to cause relative motion therebetween than would be required to cause relative motion at the joint between the lower ends of the inner tube and outer member whereby the joint at the lower ends is stronger with respect to torque resistance than the press fit joint between the upper ends of the inner tube and the outer member, the outer diameter of the upper end of the inner tube at the joint with the upper end of the outer member being larger than the diameter of the lower end of the inner tube at the joint with the lower end of the outer member, means cooperatively disposed between the inner tube and outer member adjacent the upper ends thereof to transmit axial tension from the inner tube to the outer member when the overload releasable joint has released but allowing rotation of the upper end of the outer member relative to the inner tube when the overload releasable joint has released, the inner tube being separated from the outer member between the joints forming an annular chamber extending from the joint between the upper ends to the joint between the lower ends, both of the joints being rendered fluid tight, and a fluid having a density greater than 1.4 filling the chamber, the joints being constructed and arranged to maintain the tension and compression so long as the overload releasable joint is not released.

U.S. Pat. No. 3,232,638, issued Feb. 1, 1966, to M. B. Hollander, discloses a hollow drill collar comprising, in combination, a pin connection having an outward facing annular shoulder, a box connection having an inward facing annular shoulder, an outer tubular member having high tensile strength to which the pin and box connections are screwed, and an inner tubular member longer than the outer member and having high compressive strength, both tubular members being loaded within their respective yield points, the inner member being of a length greater than the axial distance between the shoulders when the pin and box connections are tightly screwed into the outer tubular member, the inner tubular member being concentrically disposed within the outer tubular member with slight radial clearance forming an annular recess between the tubular members extending substantially the axial length of the inner member prior to loading the inner member, the annular shoulders of the pin and box connections contacting and compressing the inner tubular member when the connections are screwed to the outer tubular member, the inner tubular member being loaded in compression substantially to the critical point, causing the inner tubular member to buckle and contact the inner walls of the outer member, the inner walls preventing further buckling of the inner member at the point of contact, thereby restraining the inner tubular member to stress within its yield point, the arrangement being such that the outer member is prestressed in tension within its yield points, thereby to stiffen the drill collar against radial deformation as the collar is subjected to compressive loading.

U.S. Pat. No. 3,572,771, issued Mar. 30, 1971, to Fletcher Redwine, discloses a drill-collar construction for use in rotary drilling of well. The individual collars are joined end-to-end with connectors which have greater fatigue resistance than the steel of the drill collars. The preferred metal for the connectors is titanium or a titanium-base alloy.

U.S. Pat. No. 3,706,348, issued Dec. 19, 1972, to Carey E. Murphey, Jr., discloses a system for controlling hole deviation through the use of a bit and a composite drill string comprising a heavy drill collar disposed above the bit and conventional steel collars above the heavy metal collar.

U.S. Pat. No. 3,955,835, issued May 11, 1976, to Percy L. Farrington, discloses a gas economizer which comprises a union for insertion in a gas line leading to a gas appliance with the male portion of the union provided with a plurality of spirally extending fins to cause a swirling action in the gas passing therethrough.

U.S. Pat. No. 4,760,889, issued Aug. 2, 1988, to Roy L. Dudman, discloses a drill collar having a fishing neck just behind the pin end, which has a reduced dimension compared with the box end. Hence, the tool is particularly well suited for being oriented with its pin end up in a drill string. The BSR is enhanced while the collar retains good "fishability", and "washoverability", characteristics.

U.S. Pat. No. 4,771,811, issued Sep. 20, 1988, to DeCell et al., discloses a substantially homogeneous heavy wall drill pipe and its method of manufacture. A cylindrical ingot is placed in a multi-hammer forging press to form the ingot into a drill pipe bar having a central protector portion and upper and lower connector sections each of larger diameter than cylindrical body sections of the drill pipe. Thereafter, the bar is straightened and upper and lower end connectors are machined. Threaded end portions are machined on the connectors and a bore is drilled through the drill pipe bar.

U.S. Pat. No. 4,776,436, issued Oct. 11, 1988, to Nenkov et al., discloses a face shock absorber with a top and a bottom adapter, between which there is mounted a housing, and in it there are disposed a spindle and active elements disposed inside a chamber enclosed by a top and a bottom disk, the housing and the spindle, and underneath the bottom disk there are disposed springs. The top adapter is embraced by a two-stepped nut with external thread, screwed up to the housing, and through the two-stepped nut pass keys. The working chamber is divided by intermediate sleeves into sections, in each of which there are disposed spherical heads, shaped in the external surface of the spindle. The active elements disposed inside the working chamber are balls. The springs are limited in their bottom end by a ring-shaped nut, and it is possible to use springs of the slotted type.

U.S. Pat. No. 4,905,776, issued Mar. 6, 1990, to Beynet et al., discloses a vibration dampening assembly, such as a dynamic balancing apparatus, which is connected to a drill bit, a downhole motor or drill string to exert a variable force to counteract vibration inducing forces. The dynamic balancing apparatus includes a support body which supports a plurality of freely movable masses so that the masses move to a position for opposing an imbalance force which rotates with, and at the same speed as, the drill bit, downhole motor or drill string.

U.S. Pat. No. 6,230,822, issued May 15, 2001, to Sullivan et al., discloses a drill bit for use in drilling operations in a wellbore, the drill bit having a bit body including a plurality of bit legs, each supporting a rolling cone cutter; a coupling member formed at an upper portion of the bit body; at least one temperature sensor for monitoring at least one temperature condition of the improved drill bit during drilling operations; and at least one temperature sensor cavity formed in the bit body and adapted for receiving, carrying, and locating the at least one temperature sensor in a particular position relative to the bit body which is empirically determined to optimize temperature sensor discrimination.

U.S. Patent Application 20020157895A1, published Oct. 31, 2002, to Dubinsky et al. discloses a plurality of heavy mass irregularities attached to an inner wall of the drill collar attenuate waves traveling through the collar. The plurality of heavy mass irregularities are spaced and sized for the maximum attenuation of acoustic pulses in a predetermined frequency range. The mass irregularities may be rings firmly coupled to the outer surface of the collar. Alternatively, the mass irregularities may be rings firmly coupled to the outer collar surface by neck pieces, extending inwardly from the inner circumference of the ring. The mass irregularities may be made of steel or tungsten. In another preferred embodiment, the mass irregularities are asymmetrically coupled to an outer collar wall for providing preferential directional attenuation.

An article from *Offshore Magazine*, issued August 2001, written by Chen et al., entitled "Wellbore design: How long bits improve wellbore micro-tortuosity in ERD operations," discloses tortuosity as one of the critical factors in extended reach well operations, having two components: macro- and micro-tortuosity. The effects include high torque and drag, poor hole cleaning, drill string buckling, and loss of available drilled depth, among other negative conditions. A new drilling system using long gauge bits significantly reduces hole spiraling, one form of micro-tortuosity, which is intended by use of the drill bit design to improve many facets of the drilling operation.

The above cited prior art does not provide a durable, statically/dynamically balanced, relatively high plasticity high density material, for bottom hole assemblies to thereby dramatically improve the drilling operation by substantially solving the problems discussed hereinbefore. Consequently, there remains a need to provide an improved high density downhole assembly. Those of skill in the art will appreciate the present invention which addresses the above problems and other significant problems.

SUMMARY OF THE INVENTION

Accordingly, it is an objective of the present invention to provide an improved drilling assembly and method.

An objective of another possible embodiment is to provide faster drilling ROP (rate of penetration), longer bit life, reduced stress on drill string joints, truer gage borehole, improved circulation, improved cementing, improved lower noise MWD and LWD, improved wireline logging accuracy, improved screen assembly running and installation, fewer bit trips, reduced or elimination of tortuosity, reduced or elimination of drill string buckling, reduced hole washout, improved safety, and/or other benefits.

Another objective of yet another possible embodiment of the present invention is to provide means for transmitting the force from one or a plurality of sections of high density material through threaded connectors to any desired point there below through any number of box/pin connection up to and including placing substantially the entire weight of a plurality of high density weight sections at the top of the drill bit.

An objective of yet another possible embodiment of the present invention provides a much shorter compression length of the bottom hole assembly with respect to the first order of buckling length to thereby virtually eliminate buckling of the bottom hole assembly and the resulting tortuosity in the hole.

Another objective of another embodiment of the present invention is a larger diameter high density bottom hole assembly with a shorter length that creates less formation washout than the standard smaller diameter steel collar bottom hole assembly.

An objective of yet another possible embodiment of the present invention is providing a high density tungsten formulation which has high plasticity to avoid prior art problems of brittle tungsten weight sections.

An objective of yet another possible embodiment of the present invention is to provide high density tungsten alloy insulation sections which may be utilized in the bottom hole assembly or elsewhere in the drill string to absorb shocks, vibrations, bit bounce, bit whirl effects, and/or noise.

Another objective of yet another possible embodiment of the present invention is to provide static and/or dynamic balancing of the bottom hole assembly to eliminate flywheel vibrations produced by the bottom hole assembly.

An objective of one possible embodiment of the present invention is to provide an improved bottom hole assembly.

Another objective of yet another possible embodiment of the present invention is to provide an outer steel sleeve for the bottom hole assembly which is held in tension instead of being in compression even at close distances from the drill bit such that buckling of the drill string is eliminated.

Another objective of yet another possible embodiment of the present invention is to apply an increased amount of weight adjacent the bit and to permit increased revolutions per minute (RPM) of the drill string to thereby increase the drilling rate of penetration (ROP) in many formations.

Another objective of yet another possible embodiment of the present invention may comprise combining one or more or several or all of the above objectives with or without one or more additional objectives, features, and advantages as disclosed hereinafter.

These and other objectives, features, and advantages of the present invention will become apparent from the drawings, the descriptions given herein, and the appended claims. However, it will be understood that the above-listed objectives, features, and advantages of the invention are intended only as an aid in understanding aspects of the invention, and are not intended to limit the invention in any way, and therefore do not form a comprehensive or restrictive list of objectives, and/or features, definitions, and/or advantages of the invention.

Accordingly, in one embodiment of the invention a drilling assembly in a drill string is provided for drilling an earth formation. The drilling assembly is operable for applying a substantially continuous force on a drill bit during drilling operations to thereby maintain the drill bit in contact with the earth formation. The drilling assembly may comprise one or more elements such as, for instance, a first outer tubular, and/or a first force transfer member axially mounted within the first outer tubular and being axially moveable with respect to the first outer tubular. In one presently preferred embodiment, the force transfer member may also comprise a weight section which utilizes weight in this section and possibly numerous similar sections, to produce the substantially continuous force on the bit. Other elements may comprise a first threaded connector secured with respect to the first outer tubular and/or a first threaded connector force transfer member mounted for axial movement within and extending through the first threaded connector. The first threaded connector force transfer member is mechanically connected to the first force transfer member for transferring a force through the first threaded connector for application to the drill bit such that the transferred force comprises at least a portion of the substantially continuous force on the drill bit. Thus, the force produced by a plurality of weight sections may be transferred through threaded connectors to or adjacent the drill bit.

One embodiment of a drilling assembly in accord with the present invention may be utilized in a bottom hole drilling assembly for drilling a bore hole through an earth formation. The bottom hole drilling assembly comprises a drill bit at a bottommost portion thereof and is secured to a drill pipe string. The bottom hole drilling assembly is located at a lowermost position in the drilling string sufficiently close to the drill bit so as to be operable for applying the weight thereof to the drill bit.

One embodiment of a drilling assembly in accord with the present invention comprises one or more elements such as, for instance, a first outer tubular, a first top sub secured with respect to the first outer tubular, a first bottom sub secured with respect to the first outer tubular, and a first high density weight section mounted within the first outer tubular. The first high density weight section has a specific gravity greater than 10.0 and is preferably comprised of a tungsten alloy. Note that the specific gravity of iron is about 7.85, lead 11.35, tungsten 17.20, molybdenum 10.20, uranium 18.68, and osmium 22.48. In one preferred embodiment, the first high density weight section is slidably mounted to permit axial movement of the first high density weight section with respect to the first outer tubular.

The drilling assembly may further comprise a force transmission mechanism to transfer force, such as weight, through the threaded connectors. A second outer tubular securable with respect to the first bottom sub and a second high density weight section is mounted within the second outer tubular and is slidably mounted to permit axial movement with respect to the second outer tubular. A weight transmission element may extend through the first bottom sub and may be slidable for axial movement with respect to the first bottom sub. In one preferred embodiment, the weight transmission element is mounted for supporting the weight of the first high density weight section and/or for applying the weight of the first high density weight section to the second high density weight section.

In one preferred embodiment, a preferred tungsten alloy utilized in a downhole assembly comprises no cobalt. The tungsten alloy may comprise greater than ninety percent tungsten. The tungsten alloy may further comprise nickel, iron, and molybdenum. The alloy so created has a higher plasticity due to the absence of cobalt and is therefore better suited to withstand the stresses applied to a bottom hole drilling assembly.

One specialized use of the present invention is for a directional drilling bottom hole assembly for drilling a borehole section through an earth formation which has a varying directional angle and requires the drilling string to bend as it passes therethrough. In this case, the directional drilling bottom hole assembly may comprise a drill bit, a mud motor for rotating the drill bit, a bent sub secured with respect to the mud motor, and a flexible weight section built in accord with the present invention which is operable for applying a weight to the drill bit in angled hole sections. The flexible weight section comprises an outer tubular and an inner tubular that form a sealed compartment therebetween. The outer tubular and the inner tubular are sufficiently bendable for conforming to the varying directional angle. A tungsten powder or tungsten slurry is provided within the sealed compartment for supplying a substantial portion of the weight to the drill bit while remaining flexible within the outer tubular and inner tubular.

If desired to permit better downhole compass measurements, the inner tubular and the outer tubular may consist or be comprised of nonmagnetic materials and the tungsten powder or the tungsten slurry being substantially nonmagnetic.

A method of making a drilling assembly comprises, in one embodiment, steps such as, for instance, providing at least one tubular and at least one tungsten weight section with respective mating surfaces for interconnection therebetween, providing that a dimension of the respective mating surfaces is sized to just prevent interconnection of the tubular and the tungsten weight section when the tubular and the tungsten weight section are approximately the same temperature, providing a temperature difference greater than several hundred degrees Fahrenheit, in the range of 250 to 450 degrees Fahrenheit, between the tubular and the tungsten weight whereby the dimension is then sized to permit interconnection of the tubular and the tungsten weight section, interconnecting the tubular and the tungsten weight section while the temperature difference exists, and permitting the tubular and the tungsten weight section to reach approximately the same temperature whereby the tubular and the tungsten weight section are secured with respect to each other.

The method may further comprise inserting the tungsten weight section within the one tubular and/or inserting at least one tubular into a bore through the tungsten weight section.

BRIEF DESCRIPTION OF DRAWINGS

For a further understanding of the nature and objects of the present invention, reference should be had to the following detailed description, taken in conjunction with the accompanying drawings, in which like elements may be given the same or analogous reference numbers and wherein.

While the present invention will be described in connection with presently preferred embodiments, it will be understood that it is not intended to limit the invention to those embodiments. On the contrary, it is intended to cover all alternatives, modifications, and equivalents included within the spirit of the invention.

GENERAL DESCRIPTION AND PREFERRED MODES FOR CARRYING OUT THE INVENTION

Figure 1:
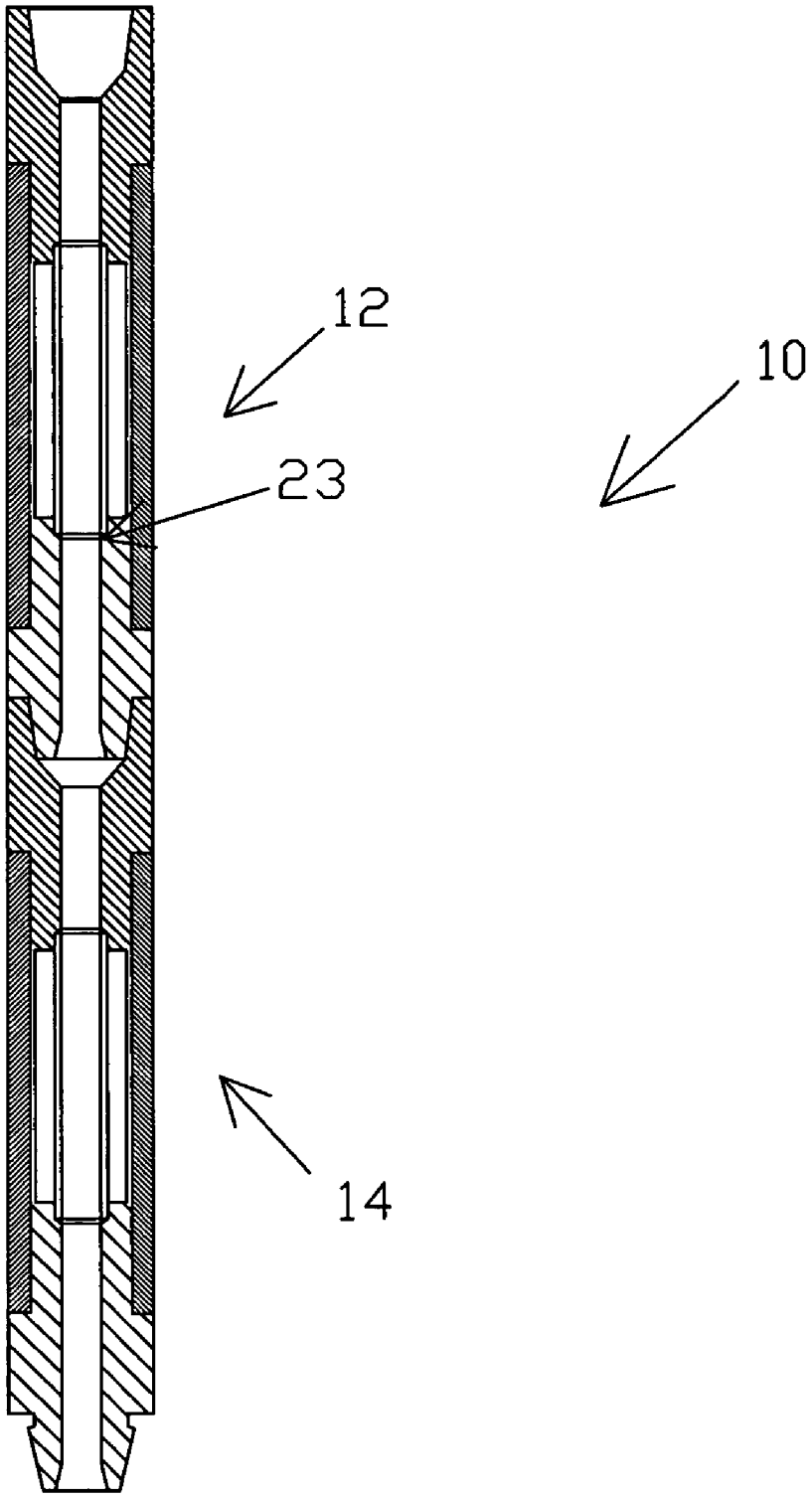
FIG. 1 is an elevational view, in cross-section, of heavy weight drill collars having high density sections in accord with one possible embodiment of the present invention.
Figure 1A:
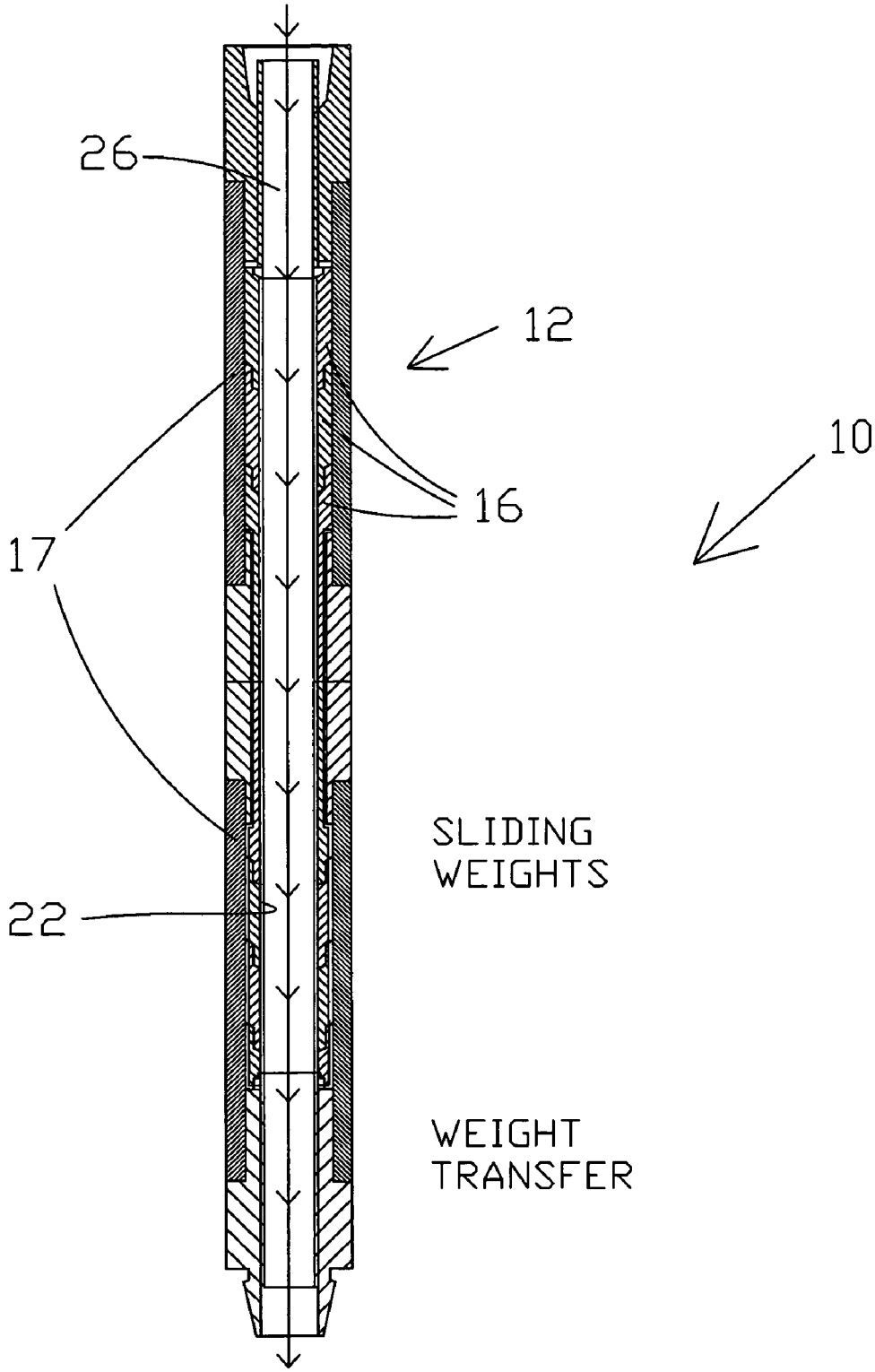
FIG. 1A is an enlarged elevational view, in cross-section, of the upper assembly 12 of FIG. 1 in accord with the present invention.
Figure 1B:
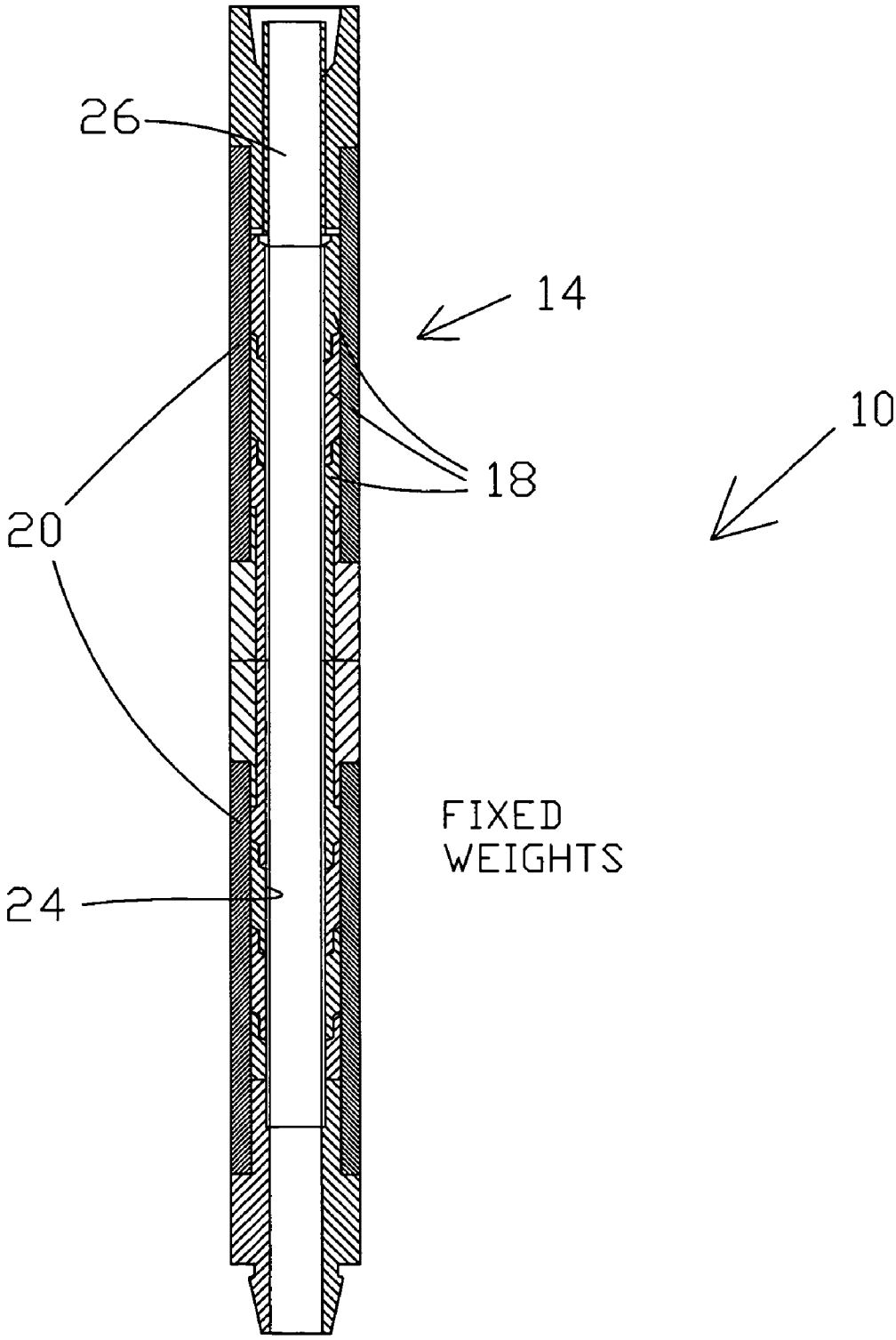
FIG. 1B is an enlarged elevational view, in cross-section, of the lower assembly 14 of FIG. 1 in accord with the present invention.

Now referring to the drawings, and more particularly to FIG. 1, FIG. 1A, and FIG. 1B, there is shown an elevational view of one possible construction of a portion of a drilling assembly 10 which may be utilized in a drill string in accord with the present invention. Drilling assembly 10 may preferably be utilized as a portion of a bottom hole drilling assembly but may also be used elsewhere in the drill string as desired. In FIG. 1, upper section 12 and lower section 14 may be the same or may be significantly different in construction. Upper section 12 is connected to lower section 14 through sub 23. FIG. 1A shows one possible construction for upper heavy weight assembly 12 and FIG. 1B shows a possible construction for lower heavyweight assembly section 14.

In the particular embodiments shown in FIG. 1A and FIG. 1B, upper assembly portion 12 and lower assembly portion 14 function differently as discussed hereinafter and may be utilized separately or in conjunction with each other. For instance, multiple upper assembly portions 12 may be threadably connected and stacked together if desired for transferring force through each assembly 12 closer to the drill bit. Alternatively, lower assembly portions 14 may preferably be stacked together to increase the weight of a bottom hole assembly.

In general operation of assembly 12 shown in FIG. 1A, inner sections, such as 16, are moveable with respect to outer sections, such as 17, to supply weight or force to the drill bit during drilling while simultaneously maintaining the outer sections 17 in tension. In comparison with the embodiment of FIG. 1B, in general operation of assembly 14 shown in FIG. 1B, inner sections 18 are not moveable with respect to outer section 24. One preferred embodiment for a bottom hole drilling assembly would utilize multiple stacked assemblies similar to assembly portion 12 which are threaded together and/or multiple stacked assemblies similar to assembly portion 14 which are in the bottom hole assembly to replace standard heavy weight steel drilling collars. Thus, assemblies 12 and 14 may be utilized independently of each other and may or may not be utilized together.

In upper assembly 12, high density section 16 is slidably mounted with respect to outside tube 17. In a preferred embodiment high density section 16 may comprise tungsten alloy as discussed hereinafter. Some benefits of the present invention may also be obtained using other high density materials such as, for example only, heavy metals, steel, depleted uranium, lead, molybdenum, osmium, and/or other dense materials. If desired, section 16 may utilize lighter weight materials to transfer force through assembly 12. However, in a preferred embodiment significant force on the bit is created by weight of multiple high density sections 16 as taught herein.

Because the weight or force associated with high density section 16 is preferably transferred to a lower sub rather than to outside tube 17, outside tube 17 and/or other outside tubes are not necessarily compressed by the weight of high density section 16. Instead tube 17 is more likely to be placed into tension depending on its relative position in the bottom hole assembly, thereby stiffening the bottom hole assembly. As discussed in more detail hereinafter, the present invention permits that a large percentage of the compression length of the bottom hole assembly (that portion of the bottom hole assembly in compression) may be reduced, as indicated graphically in FIG. 5A–FIG. 5C and FIG. 7A–FIG. 7C by use of drilling assemblies in accord with the present invention such as upper assemblies 12 and/or lower assemblies 14. The reduced compression length of the bottom hole assembly results in a stiffer assembly that rotates with less vibration and reduced or eliminated buckling-flywheel effects. The stiffer drill string can then be rotated faster and will drill a cleaner, truer, bore hole, with an increased drilling rate of penetration (ROP).

In another embodiment of the invention, as discussed in FIG. 3A–FIG. 3E, all or practically all and/or selectable lengths of the outer tubulars in the bottom hole assembly of the drill string are in tension. By drastically reducing the compression length of the bottom hole assembly as compared to the buckling point thereof, buckling of the bottom hole assembly is essentially eliminated. In the embodiments of FIG. 3A–FIG. 3E, the weight of preferred high density elements, such as tungsten alloy sections, may be transmitted through the interconnection joints to any number of other lower sections and even down to the top of the drill bit. Thus, the unbalanced flywheel effects caused by buckling of the bottom hole assembly during rotation of the drill string are substantially reduced or completely eliminated.

Drilling assemblies 12 and 14 of the present invention may comprise smaller, shorter, components than the standard 31 foot long steel heavy weight collars. Therefore, assembly section 12 and 14 can be machined or adjusted or weighted to be dynamically and statically balanced as discussed hereinafter to further reduce or eliminate all flywheel effects. The stiff, balanced bottom hole assembly will drill smoother and straighter with reduced bit whirl. As will be discussed hereinafter, a bottom hole assembly built utilizing the balanced, stiff, concentric, high weight subassemblies thereof such as drilling assembly 12 and 14, can be rotated faster. The greater balance, concentricity, increased vibration characteristics, and possibly decreased surface volume for contacting the borehole wall decreases drill string torque or resistance to the rotation of the drill string as compared to standard bottom hole drilling assemblies. ROP is often directly related to the RPM of the drill string so that doubling the drilling RPM may also double the rate of drilling penetration.

In many oil and gas fields that the rate of penetration (ROP) is also directly proportional to the weight on the bit, so that doubling the actual weight on the bit after buoyancy effects are taken into consideration may double the drilling rate of penetration.

In a preferred embodiment for a bottom hole assembly in accord with the present invention, the concentration of weight or force applied to the bit at a position near the bit significantly prevents lateral vibrational movement of the bit due to the increased force required to overcome the greatly increased inertia of the concentrated mass at the bit. Thus, bit whirling is significantly dampened or prevented resulting in a truer bore hole and faster ROP. Other vibrational effects such as bit bounce are also reduced by the elasticity and noise dampening effects of the preferred high density material utilized as discussed hereinafter. While the prior art has concentrated largely on bit design to eliminate bit whirling, bit bounce, and tortuosity, it is submitted by the present inventors that these problems are much better eliminated by the design of the bottom hole assembly tubulars as taught herein.

In the embodiment of the invention shown in FIG. 1B, assembly 14 may comprise high density section 18 which may be securely affixed to outside tube 20. Thus, in assembly 14 inner section 18 is not moveable with respect to outside tube or wall 20. One preferred means of mounting utilizes a shrink fit mounting method whereby close tolerances of the mating surfaces may prevent assembly when the temperatures of the components 18 and 20 are the same, but heating or cooling of one of the component 18 and 20 permits the assembly and provides a very secure fit after the temperature is stabilized. For instance, outside tube 20 may be heated to a high temperature, e.g., up to about 450 degrees Fahrenheit, thereby expanding. High density section 18, which has approximately the same dimension and cannot fit at equalized temperatures, may then be inserted into outside tube due to the expansion caused by a significant temperature difference. When both outside tube 20 and high density section 18 are the same temperature, then the components are held fast to each other. Note that as explained below, the high density material may preferably comprise a tungsten alloy which is designed to have similar tensile strength and elasticity as steel. Thus, the combined assembly has similar mechanical properties as standard steel heavy weight collars but has a weight almost twice that of a standard steel heavy weight collar. In heavier muds, the combined assembly may have an actual applied weight on the bit after buoyancy effects that is more than twice that of the same length of standard steel heavy weight collars. (See FIG. 6)

In the above described designs, wash pipes or inner tubulars 22 and 24 are preferably utilized on the inside of high density sections 16 and 18 to protect and preserve high density sections 16 and 18. Thus, high density sections 16 and 18 are preferably contained between inner and outer tubulars such as steel tubulars rather than exposed to circulation flow through bore 26. In a preferred embodiment, high density sections 16 and 18 are also sealed therein to prevent any contact with the circulation fluid. If desired, inner tubulars 22 and/or 24 could also or alternatively be affixed to high density sections 16 and 18 by assembling when there is a significant temperature difference that provides just enough clearance for assembly whereby after the temperatures of the components are approximately the same, the components are affixed together.

It is highly advantageous during directional drilling to be able to take a magnetic survey as close to the bit as possible. Typically, one to three hundred feet may need to be drilled before the effects of actions taken by the directional driller can be seen due to the need to keep the compass away from the magnetic bottom hole assembly. This results in sometimes getting off target and makes corrections to get back on target difficult. In one embodiment of the present invention, a nonmagnetic tungsten alloy may be utilized. In this case, inner and outer tubulars, such as 22 and 20 may comprise a nonmagnetic metal such as Monel. Because the amount of Monel required is significantly reduced as compared to prior art Monel tubulars which are typically utilized for the purpose of making magnetic surveys, the cost for Monel material is also significantly reduced. Moreover, Monel heavyweight drill collars are not normally utilized so that the compass survey data is generally not available adjacent or within the heavy weight drilling collar portion of the drill string. By permitting compass measurements closer to the bit, the drilling accuracy can be significantly improved.

Other constructions of the high density assembly for directional drilling may comprise use of tungsten powder or slurry to provide a readily bendable weight section for use in direction drilling where a stiff bottom hole assembly may cause sticking problems or even be incapable of bending the necessary number of degrees per depth required by the drilling projection. The greater flexibility and heavier weight of a bottom hole assembly in accord with this embodiment of the present invention permits greater weight to be applied to the bit even when using a bent sub with considerable angle. The ability to apply more weight on the bit during directional drilling in accord with the present invention is likely to increase the ROP of directional drilling operations thereby significantly reducing the higher cost of directional drilling. Directional drilling bottom hole assemblies may comprise mud motors, bent subs, and the like. The use of a flexible heavyweight section with this type of directional drilling assembly provides means for improved and faster directional drilling. Moreover, the use of nonmagnetic material within the bottom hole assembly itself gives rise to the potential of placing the compass much closer to the bit than is now possible thereby permitting much more accurate drilling, fewer doglegs, and better producing wells that accurately go through the drilling target or targets along an optimal drilling path with a faster ROP.

In one preferred embodiment, the tensile strength and elasticity of a preferred tungsten alloy are adjusted to be similar to that of steel. One preferred embodiment of the present invention completely avoids use of cobalt within the tungsten alloy to provide greater elasticity of the tungsten alloy. Cobalt has in the past been utilized within a tungsten alloy to increase the tensile strength thereof. However, increasing the tensile strength reduces the elasticity making the tungsten compound brittle. In accord with one embodiment of the present invention, a cobalt tungsten alloy is avoided as being unsuitable for general use in a bottom hole assembly environment when it will be subjected to many different types of stress, e.g., torsional, bending, compressive, and the like, which bottom hole drilling assemblies encounter. A presently preferred embodiment tungsten alloy in accord with the present invention comprises 93–95% W (tungsten), 2.1% NI, 0.9% Fe, and 2–4% MO. This alloy has greater plasticity than prior art tungsten alloys utilized in bottom hole assemblies and is therefore better suited to withstand the stresses created thereby. The components are preferably adjusted to provide mechanical properties similar to that of steel whereby the above formulation is believed to be optimal such that the assembly reacts in many ways as a standard steel collar.

The tungsten alloy has a high mechanical vibration impedance approximately twice that of steel which also limits vibrations in the drill string thereby reducing tool joint failure in the drill string. In one embodiment of the present invention as also discussed in connection with FIG. 8, a transition section comprising tungsten alloy may be utilized between the bottom hole assembly and the drill pipe string, or at any other desired position in the drilling string, to thereby dampen vibrations transmitted from the bottom hole assembly to the drill pipe string. The transition section may be constructed in accord with one of the construction embodiments taught herein and may be positioned between the bottom hole assembly and the drill pipe string.

Figure 2:
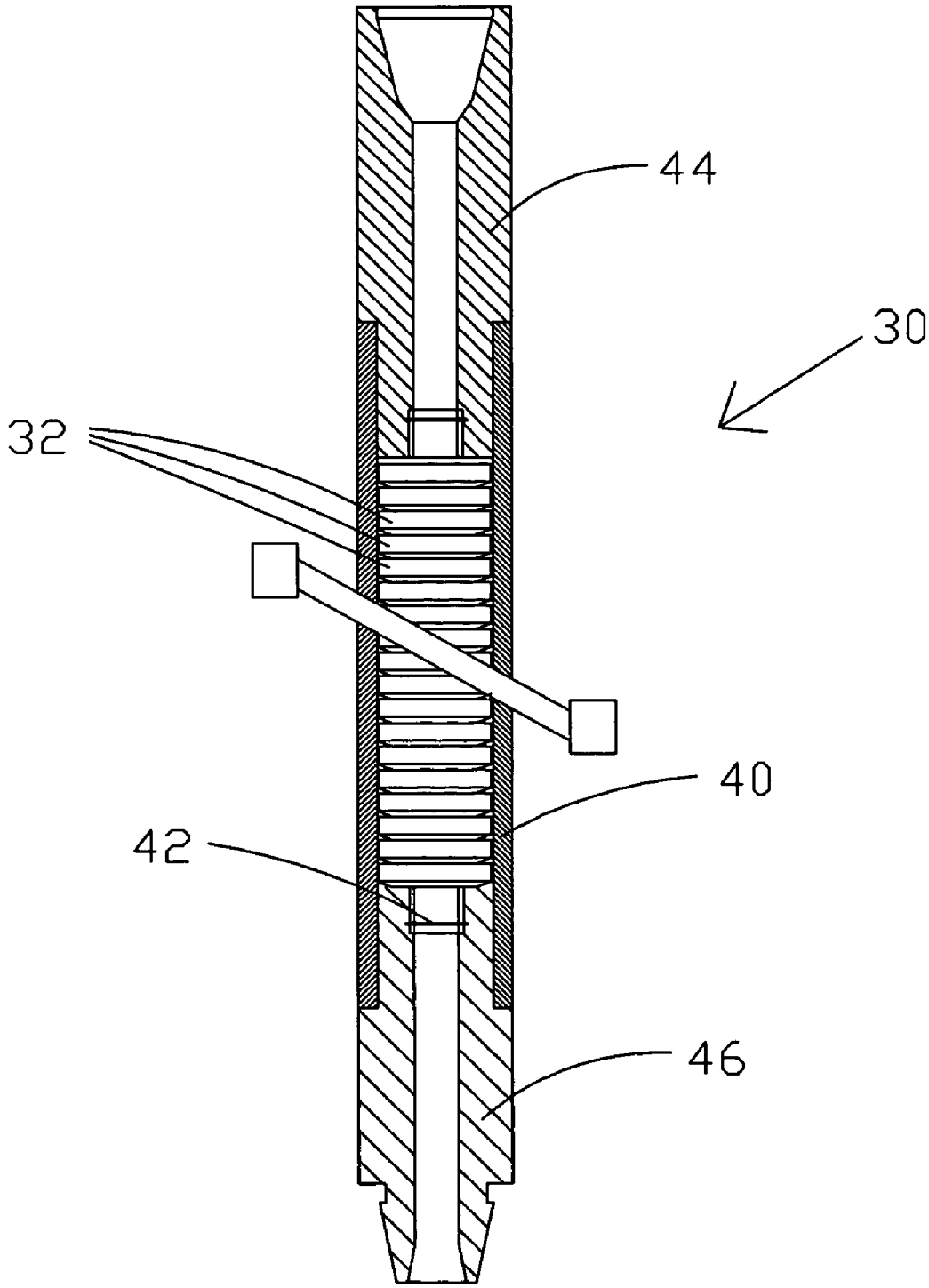
FIG. 2 is an elevational view, in cross-section, of a heavy weight drill collar having a high density section in disks in accord with one possible construction of the present invention.

FIG. 2 shows one possible construction of drilling assembly 30 in accord with one embodiment of the present invention utilizing a plurality of tungsten elements 32 stacked in mating relationship with each other. The dimensions of each tungsten element 32 are preferably tightly controlled to provide that drilling assembly 30 is balanced. Likewise, the dimensions of outer tubular 40, upper section 44, and lower section 46 are also tightly controlled. The length of assembly 30 may be approximately half that of a standard drill collar. Each element is small enough so that dimensions can be tightly controlled during machining. If any static or dynamic imbalance were detected, then a specially weighted tungsten element 32 may be utilized and inserted at a desired rotational and axial position, and fixed in position to thereby correct the imbalance. During assembly in one preferred embodiment, tungsten elements 32 are preferably inserted into outer tubular 40 when there is a large temperature difference. The dimension tolerances are selected so that only when there is a significant temperature difference is it possible to insert weighted tungsten elements 32 into outer tubular 40. When the temperature is approximately the same, the relative expansion/contraction of the components will result in a very tight and secure fit.

Drilling assembly 50 may be utilized to transfer force such as the force of the weight of heavy metal, steel, tungsten, depleted uranium, lead, and/or other dense materials from upper positions in bottom hole assembly to lower positions in the bottom hole assembly.

Figure 3A:
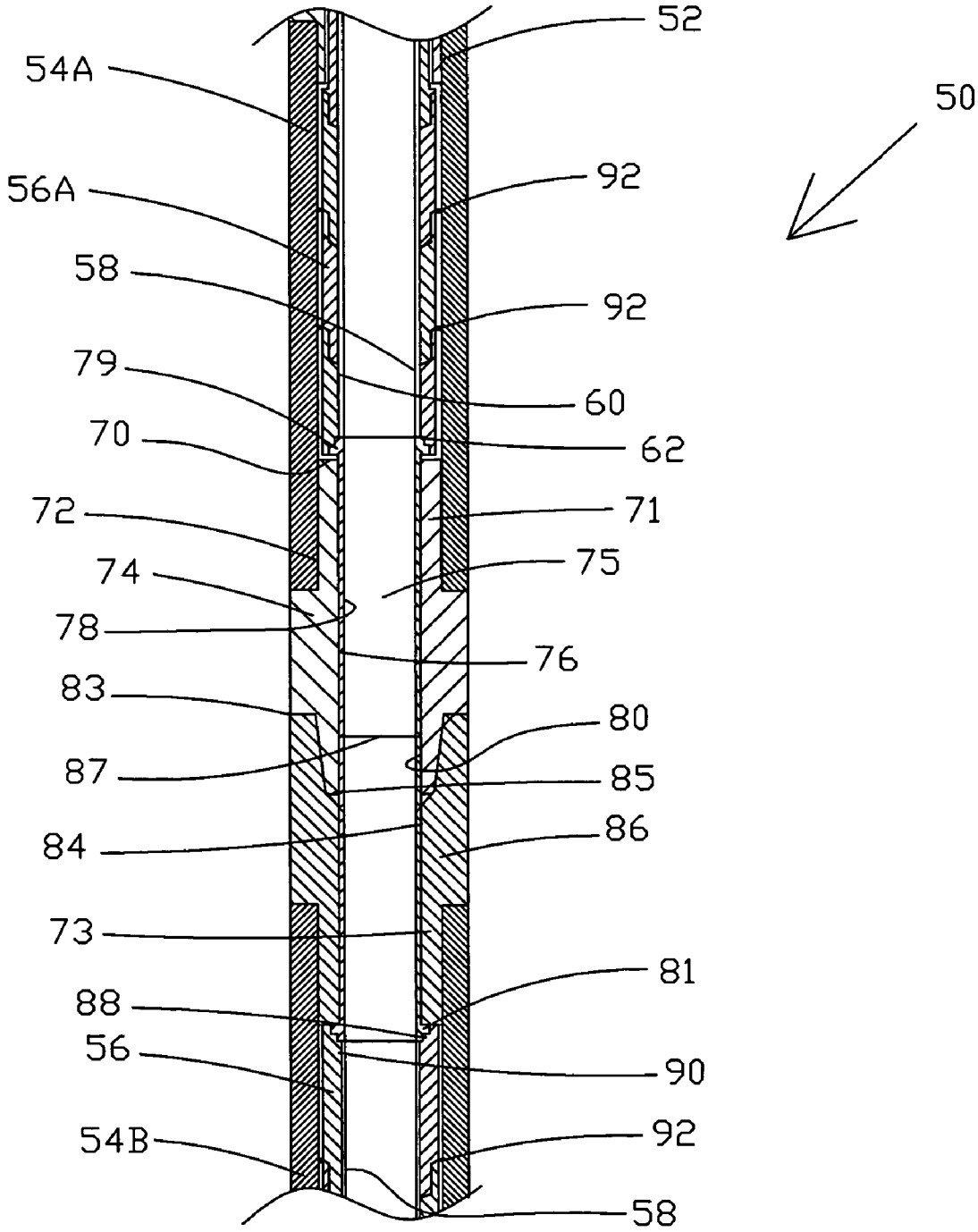
FIG. 3A is an elevational view, in cross-section, of a heavy weight drill collar with multiple high density inner sections with weight transmitting elements wherein all of the high density weight is transferred through the center of the tool for application directly to the top of the drill bit while the outer steel sheath is in tension in accord with the present invention.

FIG. 3A shows an internal construction of a portion of drilling assembly 50. Drilling assembly 50 may comprise many sections as shown in FIG. 3A which are threadably connected together, as are standard drill string tubulars, which transfer force such as force created by weight through the assembly and through the threaded connectors.

Figure 3B:
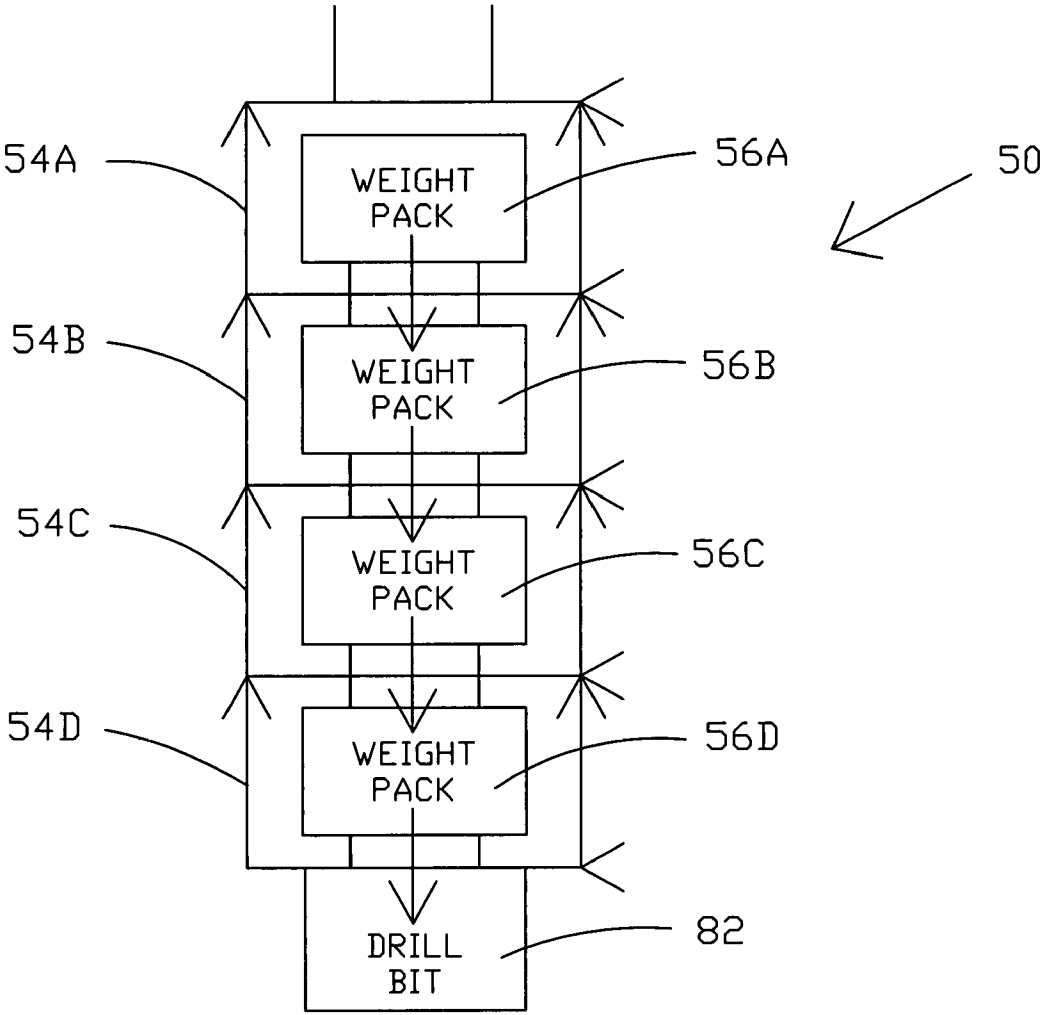
FIG. 3B is a schemmatical view showing tension and compression forces in one preferred embodiment of the present invention as per FIG. 3A wherein the gravitational force produced by tungsten alloy weight sections is transmitted directly to the bit or bit connection sub through the interior of the tool.

FIG. 3B schematically shows one possible basic mode of operation of weight transfer drilling assembly 50. Drilling assembly 50 may comprise any number of high density heavy weight section collars constructed from outer tubulars 54A–54D and moveable weight packs 56A–56D supported therein. The weight or force acting on or created within each weight pack may be collectively transferred to the next lower weight pack through the tool joints. Preferably, the high weight packs 56A–56D may comprise tungsten alloy but the slidable weight packs could comprise any material, including lower density materials, which are suitable to provide a desired weight for a particular application. Each high density weight pack 56 is interconnected by rods/tubes/or other means to thereby transmit the weight downwardly in the bottom hole assembly through a plurality of threaded connections that connect the tubulars as do standard drill string tubulars and may even transfer all weight directly to bit 82. In a preferred embodiment, a large portion or all of the string of outer tubulars 54A–54D is thereby held in tension so that collar buckling of the bottom hole assembly is effectively eliminated. The placement of the collective entire weight of one or more high density weight sections 56A–56D through a plurality of threaded connections directly on the top of bit 82 has the effect of preventing bit bounce because of the significant inertia which must be overcome to cause the bit to move upwardly. The high vibration absorbing properties of tungsten alloy in accord with the present invention also reduce the tendency of drill bit 82 to vibrate upwardly. Drill bit 82 is therefore held to the face of the formation for smoother, faster, drilling.

The ability to hold the bit face in contact with the bottom of the bore greatly increases the rate of drilling penetration especially for modern PDC bits. The PDC cutting elements of bits have a very short length and, ideally, must be held in constant contact with the surface to be cut for maximum cutting effects. Thus, a bottom hole assembly in accord with the present invention is ideally suited for maximizing the drilling potential of modem PDC bits.

Figure 4B:
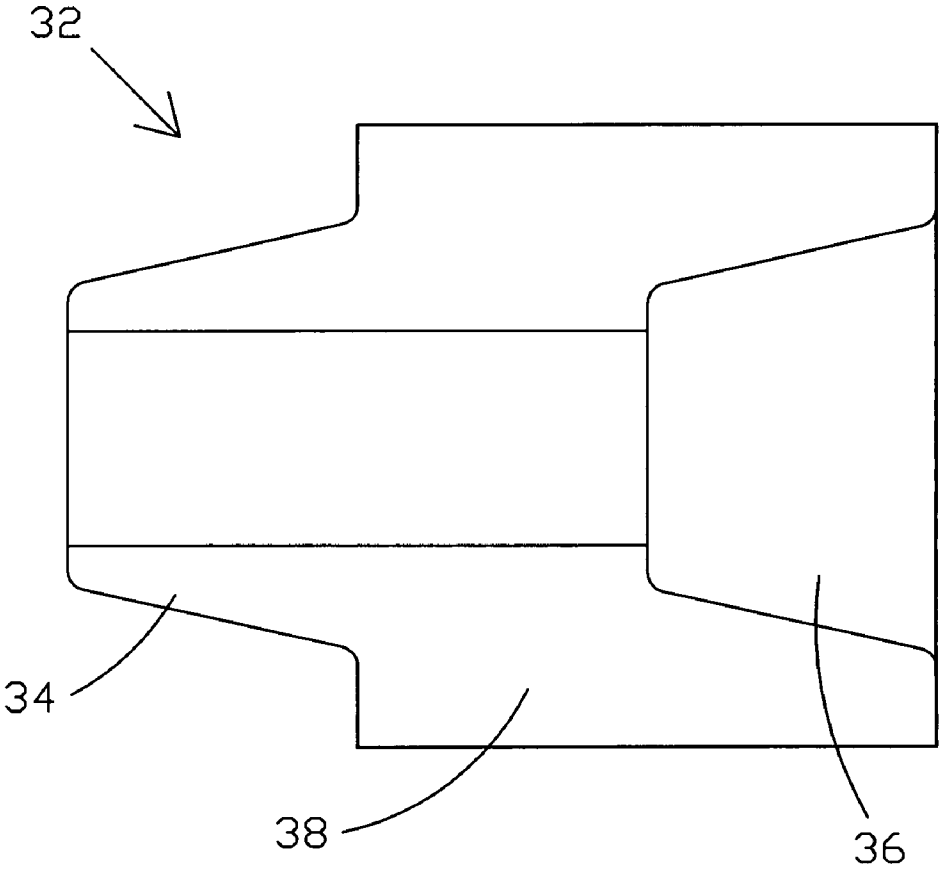
FIG. 4B is an elevational view, in cross-section, showing a tungsten alloy segment that may be utilized in combination to form a weight pack in accord with one embodiment of the present invention.
Figure 4A:
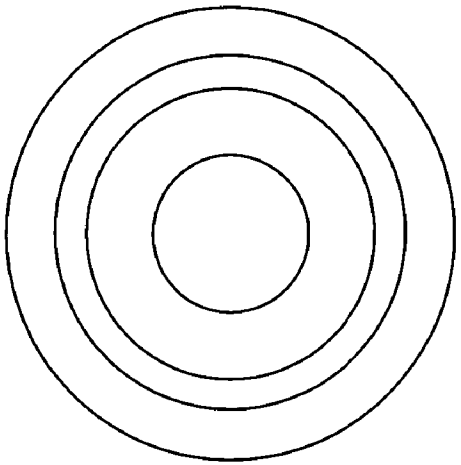
FIG. 4A is an end view of the tungsten alloy segment shown in FIG. 4B in accord with one embodiment of the present invention.

Weight packs 54A and 54B may comprise a plurality of tungsten compound elements 32, an example of which is shown in FIG. 4A and FIG. 4B. In this example, each tungsten element 32 has a pin 34, box 36, and body 38. The tungsten elements are stacked together. The relatively short tungsten elements 32 may be manufactured to very high tolerances to thereby avoid any imbalances. The completed assembly is preferably dynamically and statically balanced. If necessary, any fine tuning balancing may be accomplished utilizing tungsten elements that are weighted to offset the imbalance and positioned axially and fixed in a radial position by tabs, grooves, or the like.

Due to the flexibility of the tungsten compound of the present invention, the relative thickness of tungsten can be made relatively large as compared to the thickness of the outer tubulars such as outer tubular 20, 40, 54A, and so forth in one of the embodiments of the present invention. Thus, the present invention will have a higher density per volume as compared to some prior art devices discussed hereinbefore. For instance, in one presently preferred embodiment it is desirable that the wall thickness of body 38 be at least 25% to 50% greater than the wall thickness of the outer tubular as compared with prior art designs which utilize a thick steel jacket. For the 10.0 inch diameter assembly, which may be utilized for drilling bore holes where a prior art 9.5 inch diameter drill collar was previously utilized, and assuming a 3.5 inch bore through weight section 32 (which may be reduced closer to 2.875 for some situations as per other prior art downhole assemblies), the wall thickness is 2.25 inches as compared to a 1.0 inch wall thickness of the outer tubular. Thus, for this situation the wall thickness of weight section 32 is 125% greater than the wall thickness of the outer tubular.

In a preferred embodiment, pin 34 and box 36 may have a taper of about three to four inches per foot. This structure provides a strong connection between the weight sections 32 that has significant bending resistence thereby producing a stiffer assembly.

Weight sections 32 are stacked together and may be mounted in a shrink fit manner, by compression, or may be moveable axially. In any case, it is presently not considered necessary to provide any threads on the weight sections to interconnect with outer structural tubulars, as has been attempted in the prior art with brittle weighting material.

As shown in FIG. 3A, drilling assembly 50, which is used for force and/or weight transfer through threaded connections, may comprise one or more hollow tubulars such as tubular housing 54A or 54B. One end of each tubular housing 54A and 54B is preferably secured to a pin such as pin portion 71 of pin thread body 74. An opposite end of each tubular housing 54A and 54B may be secured to a pin such as pin portion 73 of box thread body 86. Preferably, pin portion 71 and pin portion 73 utilize the same type of thread for joining multiple tubular housings together within drilling assembly 50. It will be noted that housings such as housing 54A and 54B may comprise multiple tubulars and so be built in selectable lengths. In this case, each tubular forming a housing, such as housing 54A, may be secured with another tubular utilizing sub 52 which preferably comprises a double pin threaded body to thereby form a housing of any size length.

Located inside hollow tubular housings 54A and 54B are weight packs 56A and 56B. As discussed hereinbefore, weight packs 56A and 56B may be made from any suitable material such as heavy metal, steel, depleted uranium, lead, or other dense materials, but are preferably formed of tungsten alloy. Weight packs 56A and 56B may be made in solid form in the form of liquids or powders, e.g., tungsten powder or a tungsten slurry. Preferably, any liquids and powders are placed inside sealed containers to prevent any possible leakage. Weight packs 56A and 56B may be mounted in different ways. When used as part of a weight transfer system as illustrated in FIG. 3A, weight packs 56A and 56B are preferably free to slide up and down for a short axial distance in space 70 but completely prevented from radial movement by suitable means some of which are discussed herein.

In a preferred embodiment, weight packs 56A and 56B are preferably centered within housings 54A and 54B. In one possible embodiment, this may be accomplished by means of centering rings 92. Centering rings 92 are preferably designed to adjust to temperature and pressure changes, allowing diameter compensation for weight packs 56A and 56B in downhole applications. Centering rings 92 permit axial movement of weight packs 56A and 56B. In another embodiment, tabs, fins, grooves, tubulars, or the like could be utilized.

Figure 4D:
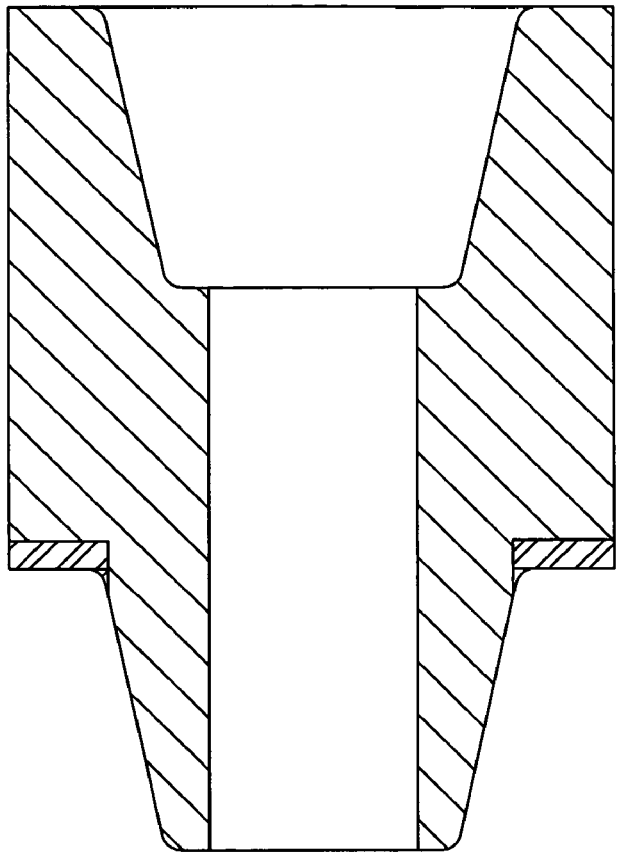
FIG. 4D is an elevational view, in cross-section, showing a tungsten alloy segment with thermal expansion tabs as one possible means for controlling the centering the as temperature changes.
Figure 4C:
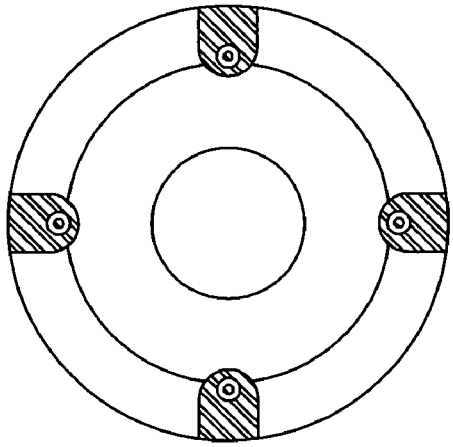
FIG. 4C is an end view of the tungsten alloy segment with thermal expansion tabs shown in FIG. 4D in accord with one embodiment of the present invention

It is not necessary that the centering elements be positioned between the outer surface of the weight packs and the inner surface of the outer tubular. For instance, as shown in FIG. 4C and FIG. 4D in another embodiment, bronze tabs may be bolted onto, for instance, pin 34. Bronze has a higher thermal expansion rate than either steel or tungsten and therefore expands during heat to keep the weight packs centralized within the outer tubular, e.g., with a fixed annular spacing substantially regardless of temperature.

However, weight packs 56A and 56B could also be restrained by shrink fit or placed in the compression between pin and box bodies, if desired. In this case, the drilling assembly would operate more like drilling assembly 14 as discussed hereinbefore.

Preferably, weight packs 56A and 56B are sealed between tubular housings 54A and 54B by wash pipes such as wash pipes 58 (See FIG. 3A) to prevent contact with fluid due to circulation flow through aperture 75 that runs through drilling assembly 50. Wash pipes 58 utilize seal 60 on a lower end thereof and seal 90 on an upper end thereof for sealing off the weight packs. Space 70 and the sealed volume enclosing weight packs 56A and 56B may preferably be filled with a non-compressible fluid for pressure balancing purposes.

In a preferred embodiment, upper transfer tube 78 and lower weight transfer tube 80 are split into two sections and engage each other at connection 87. Other arrangements could also be utilized to connect or avoid the need to connect the weight transfer element, but may require the operators to add components during installation. Thus, this construction allows operators to interconnect the components of the bottom hole assembly in substantially the way that the standard steel heavy weight bottom hole assembly is connected.

Upper weight transfer tube 78 and lower weight transfer tube 80 also utilize seals to prevent fluid leakage to weight packs 56A and 56B. Seal 62 is utilized for sealing the upper end of upper weight transfer tube 78 and seal 76 is utilized for sealing the lower end of upper weight transfer tube 78 with respect to weight packs 56A and 56B. Seal 84 and seal 88 are utilized by lower weight transfer tube 80 for the same purpose.

Upper weight transfer tube 78 and lower weight transfer tube 80 are also axially movable with weight packs 56A and 56B. Upper weight transfer tube 78 and lower weight transfer tube 80 are thereby able to transfer the weight of upper weight pack 56A onto lower weight pack 56B. Upper weight transfer tube 78 comprises upper platform 79, which engages and supports the weight of upper weight pack 56A. The force applied to upper platform 79 is applied to lower platform 81 and the top of weight pack 56B. The weight of each high density section is thereby transmitted downwardly and may even be applied through a bit sub directly to the top of the bit. The outer tubes, such as outer tubes 54A and 54B are held in tension by the relatively axially moveable weight of the weight sections to provide a stiff bottom hole assembly which effectively eliminates buckling. The truer drilling resulting therefrom may eliminate the need for stabilizers in many circumstances to avoid the cost, friction, and torsional forces created due to such use.

While one or more weight transfer tubulars, such as upper transfer tube 78 and lower weight transfer tube 80 are shown in this preferred embodiment as the weight or force transmitting element in this embodiment, other weight or force transmitting elements such as rods or the like may be utilized. As well, the weight or force transmitting elements may extend through apertures other than center bore 75 to connect the weight sections. Therefore, the present invention is not limited to utilizing split tubular force or weight transmission elements as illustrated, although this is a presently preferred embodiment. Force or transfer tubes 78 and 80 provide a relatively simple construction that permits connecting a plurality of heavyweight sections in a typical manner utilizing standard equipment for this purpose.

Figure 3C:
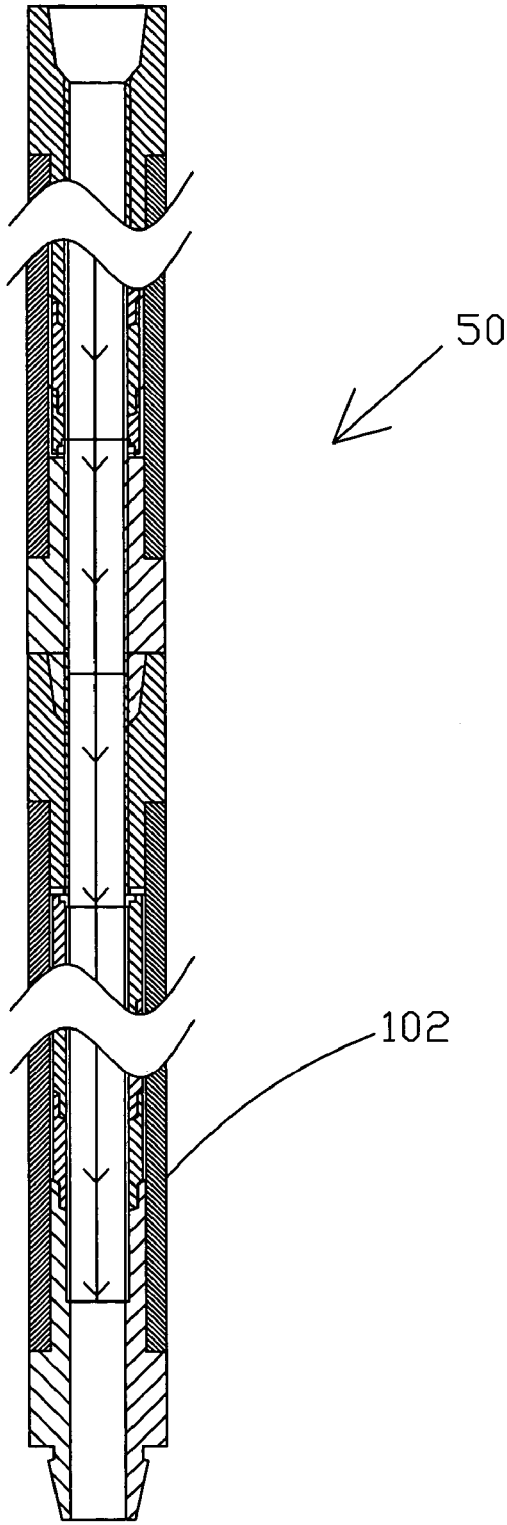
FIG. 3C is an elevational view, in cross-section, of the drilling assembly of FIG. 3A wherein the bottom hole assembly may be in tension within two feet of the drill bit in accord with one embodiment of the present invention.
Figure 3D:
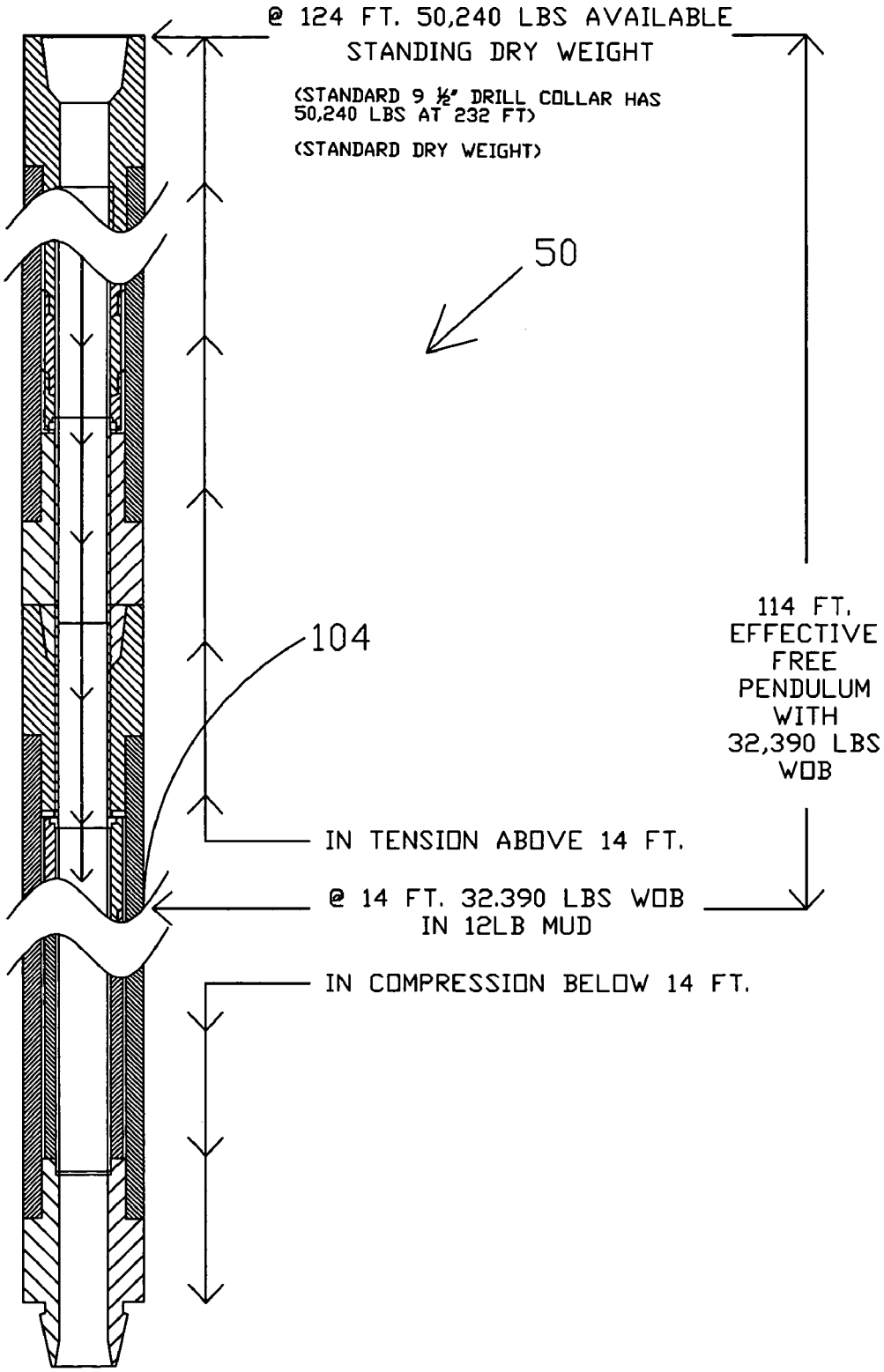
FIG. 3D is an elevational view, in cross-section, of the drilling assembly of FIG. 3A wherein the bottom hole assembly may be in tension within fourteen feet of the drill bit in accord with one embodiment of the present invention.
Figure 3E:
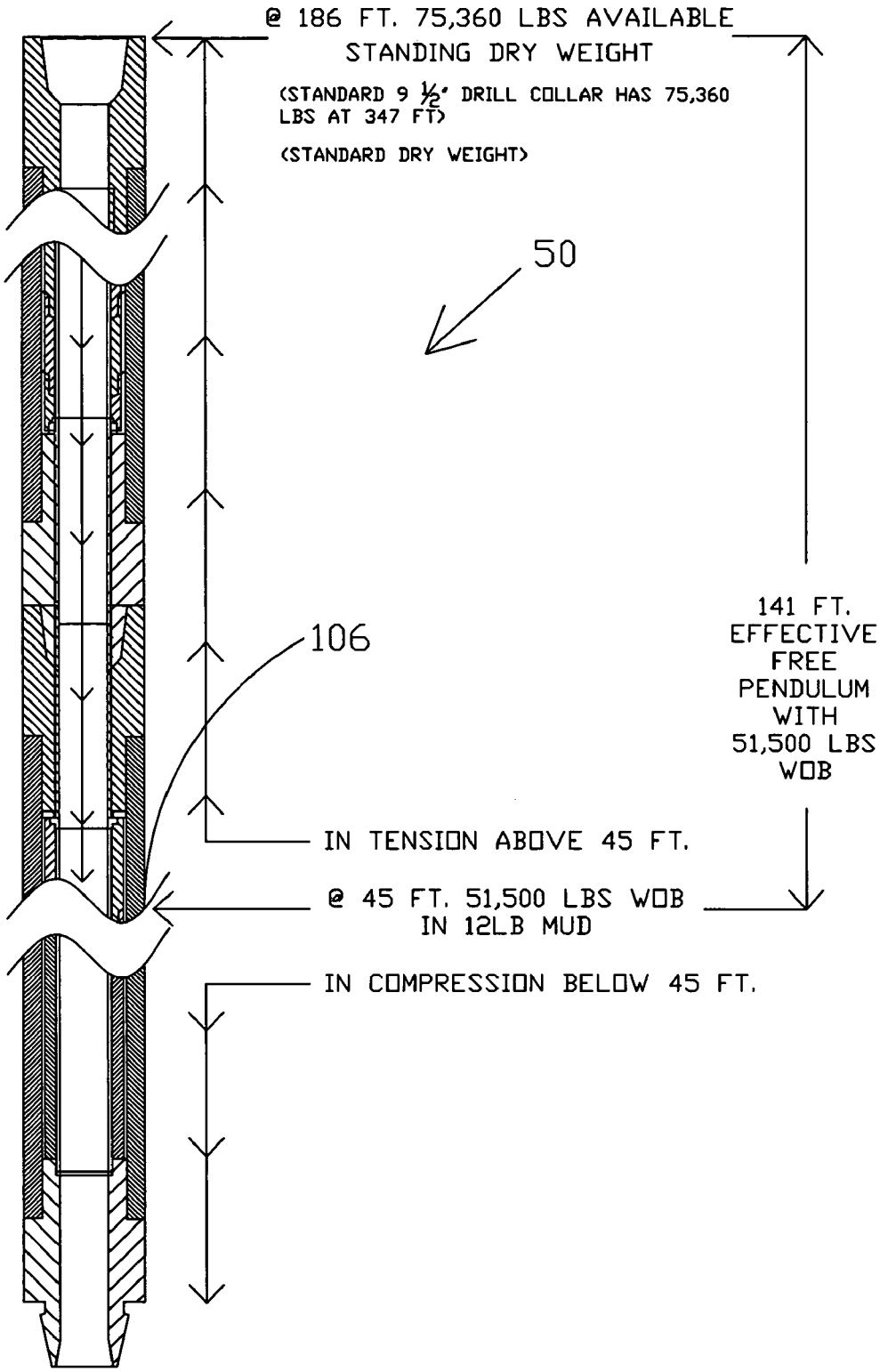
FIG. 3E is an elevational view in cross-section, of the drilling assembly of FIG. 3A wherein the bottom hole assembly may be in tension within forty-five feet of the drill bit in accord with one embodiment of the present invention.
Figure 3F:
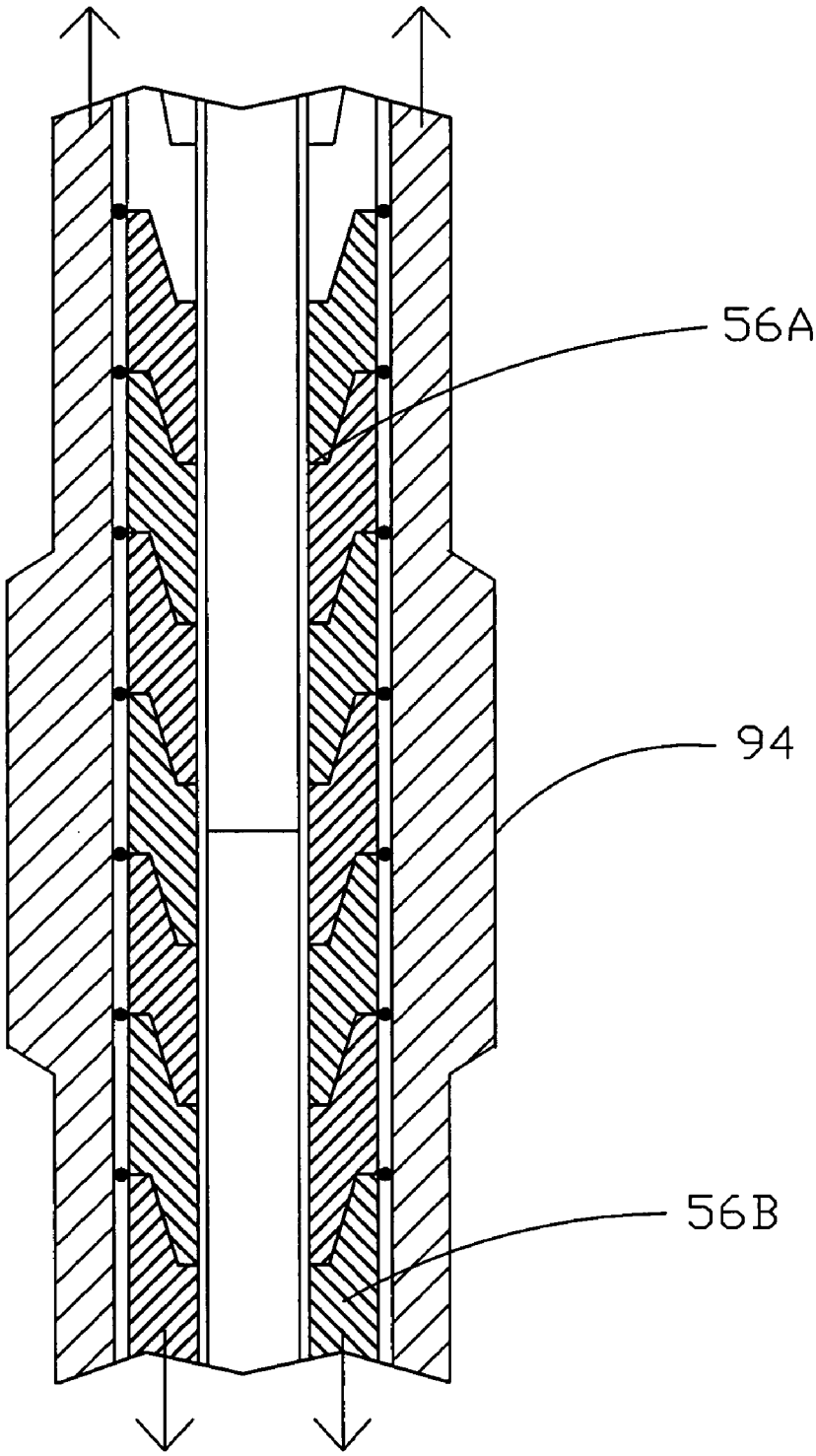
FIG. 3F is an elevational view, in cross-section, showing the transfer of weight through other drill string components such as a stabilizer or weight section with integral stabilizer in accord with the present invention.

It will be noted that the transfer of weight or force is made through a standard threaded pin-box connection 83 which is of the type typically utilized in drilling strings. In accord with the present invention, the force or weight can be transferred through any drill string component as may be desired. For instance, FIG. 3F shows the weight of weight pack 56A being transferred through stabilizer 94. If desired, stabilizer 94 can be built integral or machined in one piece with the outer tubular, thereby eliminating the need for a connection. This construction is difficult or impractical with prior art heavy weight collars that require a separate stabilizer. Due to the component structure of the present invention, it is possible to machine desirable structures such as stabilizer 94 directly into the outer tube. However, stabilizer 94 could also be mounted by other means or clamped on or provided as a separate component.

In one preferred embodiment, an enlarged or bored out aperture through a standard stabilizer permits a weight transmitting tubular to be inserted therein. The bending strength ratio for the pin-box connection has a BSR in the range of approximately 2.5 which is often a desired value to permit equal bending of the box elements and the pin so that neither element is subject to excessive bending stress. Various portions of the pin-box connection can be altered to thereby obtain a desired BSR, e.g., boring out the passageway through the joint. It is often possible to modify many standard drill string components by simply boring out the passageway and still be well within the desired BSR range so that specialized equipment is not required. Thus, the weight transmitting tubular construction may also be utilized to transmit weight or force through any type of drilling element such as stabilizers, bit connection sections, and the like.

The straight, unperturbed, continuous wall flow path through tubular weight transfer elements 78 and 80 produces a more continuous bore through the bottom hole assembly to reduce fluid turbulence and associated wear at the pin-box connections, as occurs in prior art heavy weight collar sections. The fluid turbulence and wear reduces the life of prior art heavy weight collar sections as drilling fluid is circulated through the drill string as per standard drilling operation procedures. Thus, the transfer tubular elements 78 and 80 also have the advantageous purpose of actually increasing the reliability pin-box connections as compared to prior art pin-box bottom hole assembly connections.

Figure 7A:
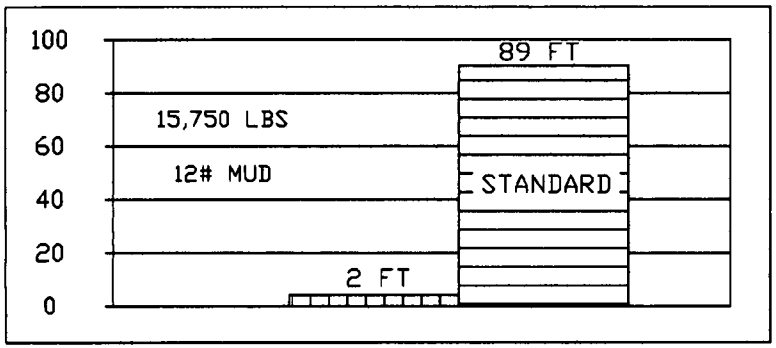
FIG. 7A is a comparison chart showing the bottom hole assembly compression lengths of two feet versus eighty-nine feet for one embodiment of the present invention as compared to standard drill collars which places the same weight on the drill bit.
Figure 7B:
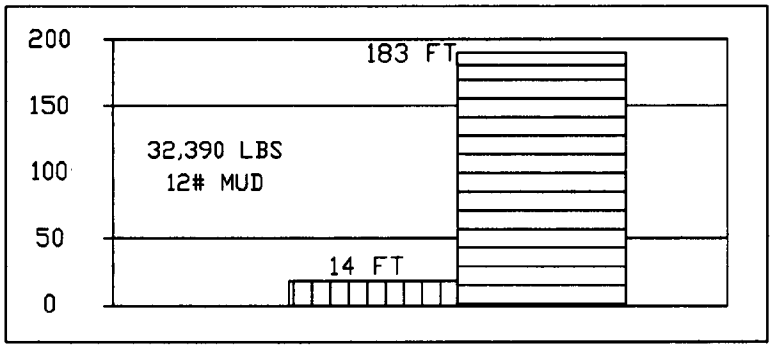
FIG. 7B is a comparison chart showing the bottom hole assembly compression lengths and relationship to the first order of buckling for one embodiment of the present invention as compared to standard drill collars which places the same weight on the drill bit.
Figure 7C:
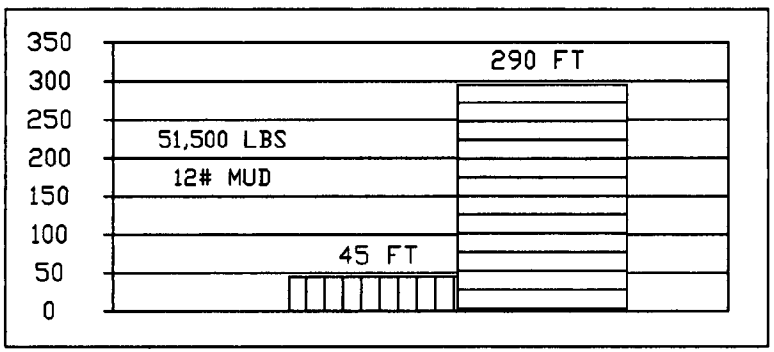
FIG. 7C is a comparison chart showing the bottom hole assembly compression lengths and relationship to the second order of buckling for one embodiment of the present invention as compared to standard drill collars which places the same weight on the drill bit.

Using multiple weight transfer packs, extremely heavy weight can be applied in a very short distance close to the actual bit or working area. FIG. 3C–FIG. 3E show examples of the use of drilling assembly 50 to apply the weight of the weight packs at distances such as two feet above the bit at point 102 in FIG. 3C, fourteen feet above the bit at point 104 in FIG. 3D, and 45 feet above the bit at point 106 in FIG. 3E. Comparison of these values with prior art heavy weight sections are shown in the graphs of FIGS. 7A–7C. The outer tubulars above these points are therefore in tension providing for a stiff, concentrically balanced, bottom hole assembly. Many different combinations of the components of the drilling assemblies such as drilling assembly 14 and drilling assembly 50 can be made to add as much weight to the bottom hole assembly in a desirable position for efficient drilling. All this can be done to maximize the weight on the bit and stay far below the buckling points of standard down hole tools.

The use of the present invention eliminates or significantly reduces most of the current problems associated with heavy weight drilling requirements such as bending of the bottom hole assembly, buckling of the bottom hole assembly, pressure differential sticking, broken or damaged thread connections, crooked hole boring or drilling, hole washouts, bent drill pipe, down hole vibrations, bit whirl, drill string whip, drill string wrap (wind-up), drill bit slap-stick, bit wear, bit bounce, and others. With the reduction or elimination of these problems, it is anticipated that increased rates of penetration can be achieved and overall costs significantly reduced.

Figures 5A, 5B, 5C:
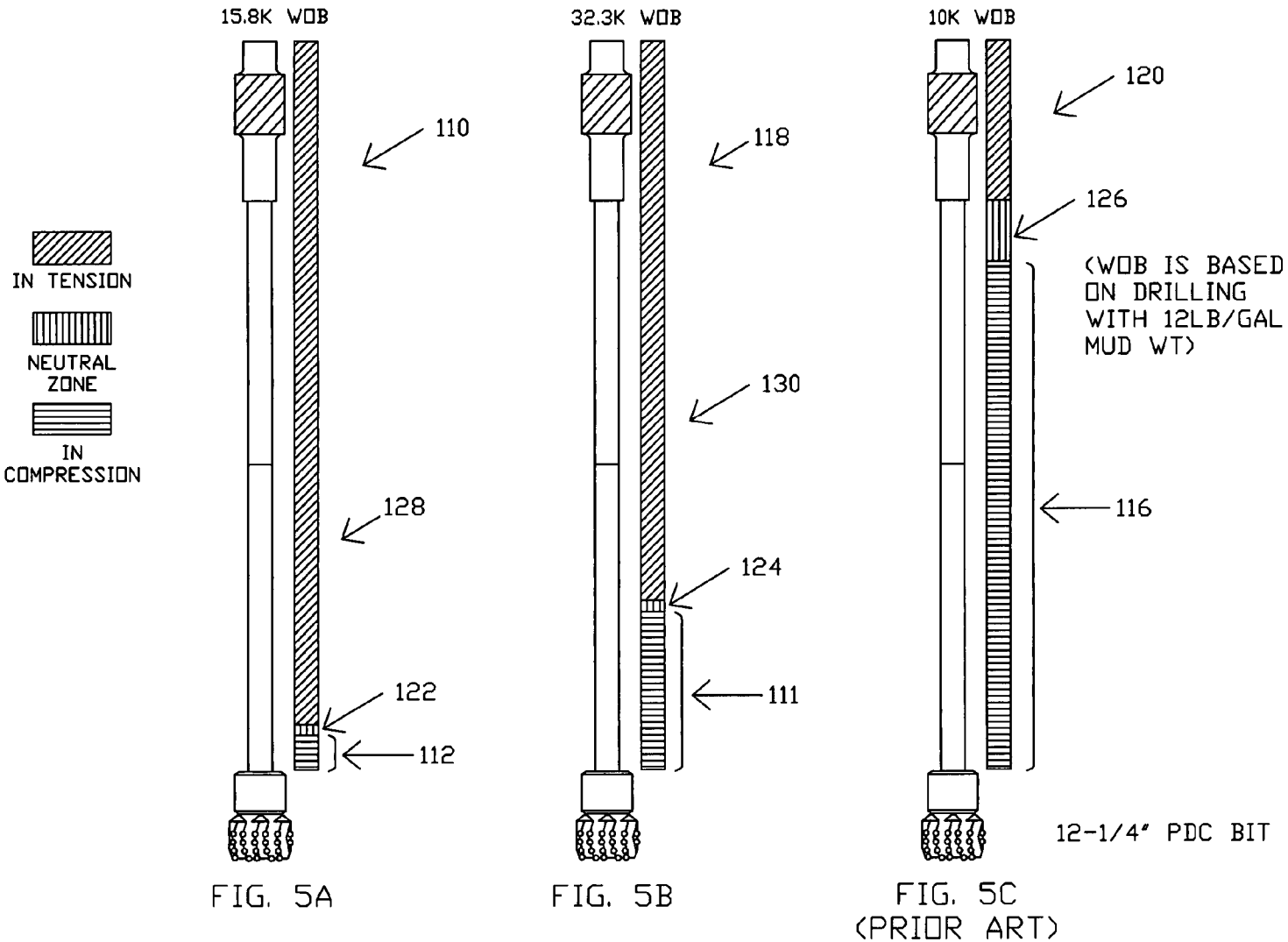
FIG. 5C (PRIOR ART)
FIG. 5A is an elevational view showing a bottom hole assembly in accord with the present invention which shows the concentration of 50% more useable weight on the bit with a very short compression length of the bottom hole assembly than a comparable prior art bottom hole assembly as shown in FIG. 5C.
FIG. 5B is an elevational view showing a bottom hole assembly in accord with the present invention with 300% more useable weight on the bit and a significantly shortened compression length of the bottom hole assembly as compared to the prior art shown in FIG. 5C.
FIG. 5C is an elevational view showing a prior bottom hole assembly for comparison purposes with embodiments of the present invention shown in FIG. 5A and FIG. 5B.

FIG. 5A–FIG. 5C show an embodiment of the present invention which illustrates that the compression length of the bottom hole assembly is adjustable and may be greatly shortened as compared to prior art drilling assemblies. For instance, in FIG. 5A compression length 112 provides about 15.8 thousand pounds weight on the bit in 12 lb./gal mud. The short compression length 112 shown for bottom hole assembly 110 in accord with the present invention is easily comparable visually with the much longer compression length 116 for bottom hole assembly 120 utilizing standard steel drill collars shown in FIG. 5C. Standard bottom hole assembly 120 provides only 10.0 thousand pounds and still has a much longer compression length. Bottom hole assembly 120 is much more subject to bending/buckling problems and many other problems as discussed above. As shown in FIG. 5B, compression length 111 is much shorter than compression length 116 but provides a weight on the bit (WOB) of 32.3 thousand pounds or more than three times the WOB as the prior art standard configuration shown in FIG. 5C. Accordingly, it will be anticipated that the configuration of FIG. 5B will drill faster and truer than the prior art configuration of FIG. 5C.

As discussed above, a shortened compression length for the down hole drilling assembly has many advantages, e.g., reduced buckling for truer drilling. It will be noted that above each compression length is a respective neutral zone 122, 124, 126. Above each neutral zone 122, 124, and 126, the drill string is in tension and therefore not subject to buckling. By utilizing the drilling assembly of the present invention, a much larger percentage of the bottom hole assembly is in tension to thereby provide a stiffer bottom hole assembly that will drill a truer gage hole at higher ROP as explained hereinbefore.

Figures 6A, 6B:
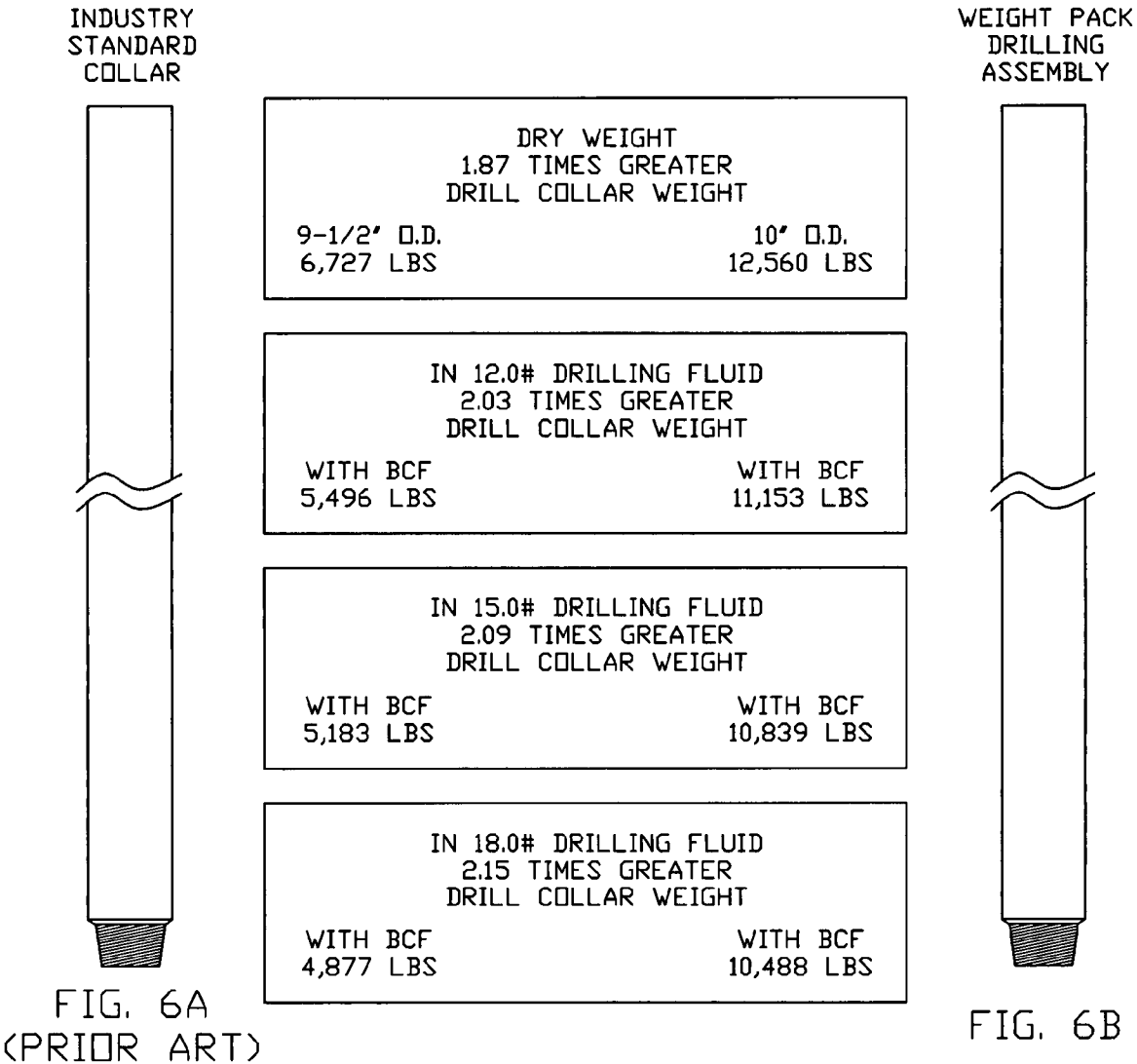
FIG. 6A (PRIOR ART)
FIG. 6 is a comparison chart showing the effect of buoyant forces of different weight mud for a prior art heavy weight steel drill collar as compared to a high density heavy weight drill collar in accord with the present invention.

FIG. 6 shows one preferred embodiment wherein the diameter of a high density drilling assembly of the present invention may preferably be somewhat enlarged as compared to a standard diameter drill collar. Even though the diameter is enlarged as compared to a standard diameter drill collar, the washout produced by the present invention due to the velocity of fluid through the smaller annulus can be reduced as can be mathematically shown as per the attached equation listings. This is because the length of the heavy weight drill collars can be reduced while still providing the same weight. This analysis ignores the significant effects of faster ROP in reducing washout. Also, this analysis ignores the significant effect of a truer, straighter hole on washouts, which effect is very important. Thus, the same weight of the bottom hole assembly can be provided in a bottom hole assembly that is much shorter, by about one-half. Due to this shortened length, less washout occurs than with a standard steel bottom hole assembly. Prior art larger diameter bottom hole assemblies as discussed in the prior art section had significant problems with washout although the use of wider diameter bottom hole assemblies had the beneficial effects of placing at least some weight closer to the drill bit. Moreover, because the actual weight on the bit may be about several times as much by utilizing the present invention, the rate of penetration may be much faster drilling thereby further reducing borehole washout. The total circulating system pressure drop is also lowered because of the shorter bottom hole assembly. The shorter length of the bottom hole assembly also decreases the likelihood of sticking in the borehole such as differential sticking or other types of sticking making the drilling operation more trouble free of drastic events that may cause loss of the hole.

FIG. 7A is a comparison chart showing the bottom hole assembly compression lengths of two feet versus eighty-nine feet for one embodiment of the present invention as compared to standard drill collars which places the same weight on the drill bit (WOB). FIG. 7B is a comparison chart showing the bottom hole assembly compression lengths and relationship to the first order of buckling for one embodiment of the present invention as compared to standard drill collars which places the same weight on the drill bit. The first order of buckling is approximately 150 feet for a standard 9.5 inch steel drill collar assembly in 12 lb. mud. The second order of buckling is 290 feet. This compares to a first order of buckling for a 10-inch assembly in 12 lb. mud for the present invention of 140 feet and a second order of buckling of 275 feet. In the present invention, the drilling string is in tension at the position of the first and second order of buckling thereby reducing or eliminating buckling. The formulas for these calculations are as follows:

$$1.94\sqrt[3]{(\sqrt{E*144*I*P^2}\div P}=\text{First Order of Buckling}$$

$$3.75\sqrt[3]{E*144*I*P^2}\div P=\text{Second Order of Buckling}$$

where:

E=moment of Elasticity

I=moment of Inertia, and

P=Lbs-ft buoyed weight

In the situation of FIG. 7A for 15,750 lbs. weight on the bit (WOB) in 12.0 lb. mud, a bottom hole assembly in accord with the present invention has a compression length that is, for all practical purposes, completely unaffected by buckling.

In the situation of FIG. 7B for 32,390 lbs. WOB in 12.0 lb. mud, a bottom hole assembly in accord with the present invention has a compression length one-tenth of the first order of buckling and so is almost unaffected. However, with a standard drilling assembly, the compression length is greater than the first order of buckling and so the bottom hole assembly is likely to produce substantial wobbling or an unbalanced flywheel effect during rotation.

In the situation of FIG. 7C for 51,500 lbs. WOB in 12.0 lb. mud, a bottom hole assembly in accord with the present invention has a compression length of only about one-quarter of the first order of buckling. To obtain the same WOB with a standard drilling assembly requires a compression length of 290 feet wherein the bottom hole assembly is subject to both first and second order of buckling and is likely to produce substantial wobbling during drilling.

A review of the above description shows that the present invention may be utilized to either greatly increase the stiffness of the bottom hole assembly or greatly increase the flexibility thereof, depending on the desired function.

Figure 8:
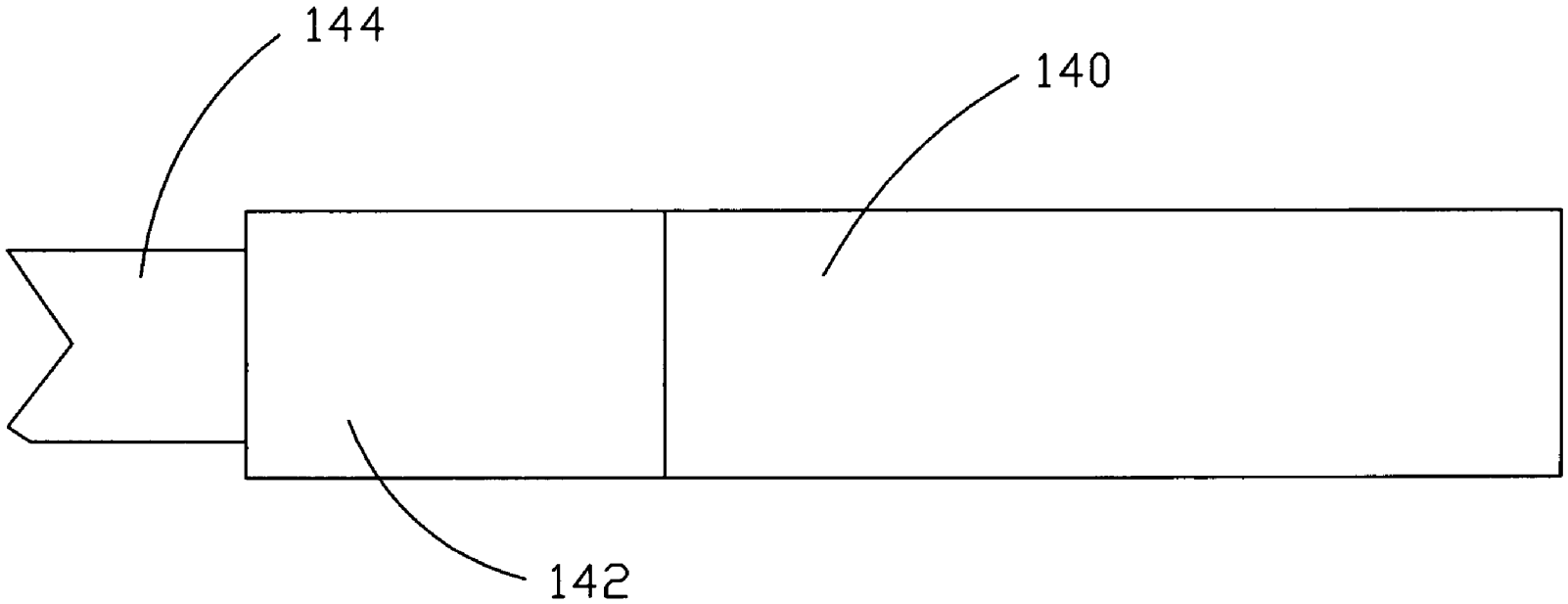
FIG. 8 is a schemmatical elevational view of one possible use of the present invention as a transition member between the drill pipe and the bottom hole assembly to provide improved drilling operation.

FIG. 8 shows another use of the present invention as a transition element 142 that may be utilized to interconnect bottom hole assembly 140 to the drill pipe string 144. Due to the significant vibration dampening effect of tungsten, the vibrations produced during drilling in the bottom hole assembly can be dampened significantly. This protects the pipe connections and also permits a better signal to noise ratio for acoustic signals transmitted through the drill string or mud for MWD and LWD equipment. The weight packs are still useful for adding weight to and/or shortening the length of bottom hole assembly 140, as discussed hereinbefore. The transition member can be utilized in other locations in the drill string or in multiple positions, if desired.

Figure 9:
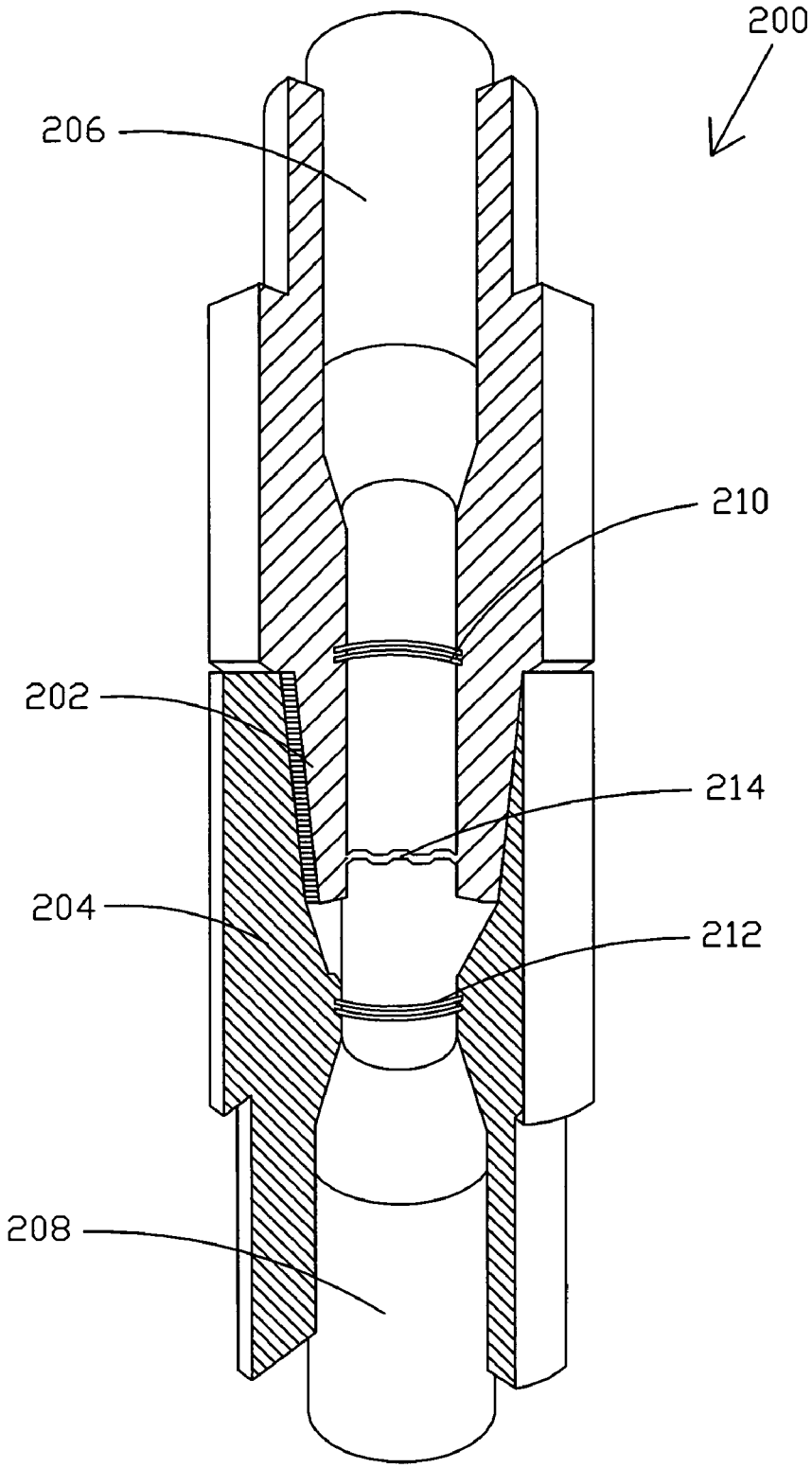
FIG. 9 is an elevational view, partially in cross-section, of a force transfer threadable connection in accord with the present invention.

Force transfer section 200 shown in FIG. 9 provides an enlarged view of a presently preferred embodiment for transferring force, such as weight through threaded pin connection 202 and threaded box connection 204. It is well known that a drilling rig may be utilized for making up and breaking out connections such as 202 and 204 for use in a drilling string. Force transfer section 200 comprises axially moveable upper force transfer tube 206 and lower force transfer tube 208 which may be utilized to transfer force through the threaded connections, such as weight to be applied to the drill bit, as explained heretofore in some detail. Mud seals 210 and 212 may be utilized to seal around the respective upper and lower force transfer tubes. If desire, any suitable anti-rotation connection, such as anti-rotation connection 214 as illustrated, may be provided so that upper force transfer tube 206 and lower force transfer tube 208 do not rotate with respect to each other. It will be noted that upper transfer tube 206 extends axially within pin connection 202 and lower transfer tube 208 extends axially within box connection 204 for transferring force through the connection. It will also be readily apparent that pin connection 202 and box connection 204 can be made up or broken out utilizing standard drilling rig equipment without need for modification thereto. As used herein a drilling rig may include derricks and the like utilized for making up and breaking out tubulars such as workover rigs, completion units, subsea intervention units, and/or coiled tubing units utilized and/or other units for providing long tubulars in wells.

As discussed hereinbefore, another aspect of the present invention is a statically and dynamically balanced drilling assembly. The tolerances on the relatively small components are quite tight and preferably require that the components, such as weight packs and outer tubular be machined round within 0.005 inches and may be less than 0.003 inches. In this way, the rotation axis coincides with one of the principal axis of inertia of the body. The condition of unbalance of a rotating body may be classified as static or dynamic unbalance. For instance, the assembly may be tested to verify that it does not rotate to a "heavy side" when free to turn. Thus, the center of gravity is on the axis of rotation. An idler roll may be in perfect static balance and not be in a balanced state when rotating at high speeds. A dynamic unbalance may occur when the body is in static balance and is effectively a twisting force in two separate planes, 180 degrees opposite each other. Because these forces are in separate planes, they cause a rocking motion from end to end. In the prior art, due to the buckling and bending of the downhole assembly, there is little motivation to attempt to provide a balanced bottom hole assembly because the buckling and bending will cause significant imbalance regardless. For dynamic balancing, the drilling assembly is first statically balanced. After rotating to the operating speed, if necessary, any dynamic unbalance out of tolerance is eliminated by adding or subtracting weight as indicated by a balancing machine. The determination of the magnitude and angular position of the unbalance is the task of the balancing machine and its operator. As discussed hereinbefore, any imbalance out of tolerance can be corrected because the weight pack is provided in sections, any one of which can be rotatably adjusted as necessary and axially positioned. If desired, grooves, pins, or the like may be utilized on pin 34 and socket 36 for weight elements 32 such that each weight element can be affixed in a particular rotational position. A permissible imbalance tolerance is determined based on the mass of the downhole assembly and the anticipated rotational speed.

In summary, the present invention provides a much higher average weight per cubic inch for a downhole assembly. For instance a weight/per unit volume or average density of standard steel heavyweight collar may be about 0.283 pounds per cubic inch wherein an average weight per unit volume of a drilling assembly of the present invention is significantly greater and may be about 0.461 pounds per cubic inch. The vibration dampening characteristics of tungsten reduce bit vibrations for smoother drilling. A heavier average weight per unit volume permits use of a shorter compression length of the bottom hole assembly. The concentration of weight closer to the drill bit reduces bit whirl and bit vibration and bit bounce. In a preferred embodiment, the drilling assemblies of the present invention are much more highly balanced than prior art bottom hole assembly elements due to much tighter control of overall tool concentricity and straightness. Increased rate of penetration occur due to reduced bit wear, vibration dampening, reduced bit whirl, and reduced bit bounce. Because of decreased vibration, fewer trips are required because the bit life is lengthened and the tool joints are less subject to vibration stress. Lower torque stress is applied to the drilling string because of less wall contact by the bottom hole assembly due to decreased surface area and more concentric rotation thereof. The compression length of a bottom hole assembly in accord with the present invention is much reduced as compared to the first or second order of tubular buckling (see attached calculation sheets) so that the bottom hole assembly in accord with the present invention is straighter. It should also be noted that a more highly balanced, vibration dampened, bottom hole assembly built utilizing weighting assemblies such as drilling assembly 10, 12, 14, 30, or 50, or variations thereof can be rotated faster with less vibration and harmonics to thereby increase drilling rates of penetration.

The weight transfer assembly is operable to transfer the inner weight of several drill collars through the tool joints from the upper collar to a lower or lowest point in the drill string while keeping the entire BHA (bottom hole assembly) in tension. There are no bending or buckling moments in the string and all of the weight may be placed directly above the bit. The collars may be the same length as standard drill collars and there is no difference in make-up or break-out. The near bit assembly may have a tungsten matrix weight while the assemblies above may have tungsten/lead weights. The tungsten matrix reduces vibration, bounce, and chatter and provides more power in a compact area directly above the bit. By transferring the weight for drilling to a point very near the drill bit, the neutral point is also lowered to that point. Additionally putting the weight directly above the bit increases the force of restitution (force required to move a pendulum from its vertical position) and increases the centripetal force that cause a body to seek a true concentric axis of rotation. Placing the weight near the bit increases the inertia or impact of the bit against the formation and holds the bit steadier against the formation as may be especially desirable for certain types of drill bits. The resistance to drag is also increased due to the greater inertia resulting in a more stable drilling speed of the bit.

The foregoing disclosure and description of the invention is therefore illustrative and explanatory of a presently preferred embodiment of the invention and variations thereof, and it will be appreciated by those skilled in the art, that various changes in the design, manufacture, layout, organization, order of operation, means of operation, equipment structures and location, methodology, the use of mechanical equivalents, as well as in the details of the illustrated construction or combinations of features of the various elements may be made without departing from the spirit of the invention. For instance, the present invention may also be effectively utilized in coring as well as standard drilling. Moreover, the present construction may be utilized in other tools and for other purposes such as hammer drilling. For instance, with hammer drilling the present invention is operable to apply more weight at the bottom of the drilling string without damage to the drilling string.

In general, it will be understood that such terms as "up," "down," "vertical," and the like, are made with reference to the drawings and/or the earth and that the devices may not be arranged in such positions at all times depending on variations in operation, transportation, mounting, and the like. As well, the drawings are intended to describe the concepts of the invention so that the presently preferred embodiments of the invention will be plainly disclosed to one of skill in the art but are not intended to be manufacturing level drawings or renditions of final products and may include simplified conceptual views as desired for easier and quicker understanding or explanation of the invention. Thus, various changes and alternatives may be used that are contained within the spirit of the invention. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative of a presently preferred embodiments and not in a limiting sense.

What is claimed is:

1. A drilling assembly in a drill string for drilling an earth formation, said drilling assembly being operable for applying a substantially continuous force on a drill bit during drilling operations to thereby maintain said drill bit in contact with said earth formation, said drilling assembly being threadably connectable utilizing a drilling rig, said drilling assembly comprising:

a first outer tubular;

a first threaded connector secured with respect to said first outer tubular;

a first threaded connector force transfer member mounted for axial movement within, said first threaded connector, said first threaded connector force transfer member being operable for transmitting at least a portion of said substantially continuous force through said first threaded connector;

a second outer tubular;

a second threaded connector secured with respect to said second outer tabular; and a second threaded connector force transfer member mounted for axial movement within said second threaded connector, said first threaded connector and said second threaded connector being threadably connectable utilizing said drilling rig, and after said first threaded connector and said second threaded connector are connected utilizing said drilling rig, then said second force transfer member is mechanically interconnected with said first force transfer member for receiving said at least a portion of said substantially continuous force.

2. The drilling assembly of claim 1, wherein said first outer tubular is in tension rather than compression when said substantially continuous force is applied to said drill bit during said drilling operations.

3. The drilling assembly of claim 1, further comprising:

a first force transfer member axially mounted within said first outer tubular and being axially moveable with respect to said first outer tubular, and a second force transfer member axially mounted within said second outer tubular and being axially moveable with respect to said first outer tubular, said first force transfer member, said first threaded connector force transfer member, said second threaded connector force transfer member, and said second force transfer member being interconnected after said first treaded connector and said second threaded connector are threadably connected for transmitting said at least a portion of said substantially continuous force.

4. The drilling assembly of claim 3, wherein said first transfer member comprises an annular weight section having a specific gravity greater than 10.0, said annular weight section creating at least a portion of said force for transfer through said threaded connector by said first threaded connector force transfer member.

5. The drilling assembly of claim 1, further comprising a first force transfer assembly axially mounted within said first outer tubular and being axially moveable with respect to said first outer tubular, at least a portion of said first force transfer assembly being temperature sensitive for controlling movement of said first force transfer assembly within said first outer tubular.

6. The drilling assembly of claim 1, further comprising a first force transfer member axially mounted within said first outer tubular and being axially moveable with respect to said first outer tubular with at least a portion thereof being temperature sensitive, and a temperature compensated centralizer for centralizing said first force transfer member within said first outer tubular.

7. A method for drilling a borehole in an earth formation with a drill pipe string, said drill pipe string comprising a drilling assembly and a drill bit, said method comprising:

connecting together a plurality of threaded connections associated with a plurality of tubulars utilizing a drilling rig to thereby form said drilling assembly;

providing a respective slidable force transfer section within one or more of said plurality of tubulars;

transferring a force through each respective force transfer section toward said bit through said plurality of threaded connections such that said force is applied to said drill bit during drilling of said borehole; and and holding one or more of said plurality of tubulars in tension with said drill pipe string during said drilling of said borehole.

8. The method of claim 7, further comprising providing that each of said slidable force transfer sections comprise high density material with a specific gravity greater than 10.0, said force applied to said drill bit comprising a cumulative weight of said each slidable force transfer section.

9. A drilling assembly for use in a bottom bole drilling assembly for drilling a bore hole through an earth formation with a drill bit said drilling assembly being securable to a drill pipe string, said drilling assembly being operable for applying drilling weight to said drill bit said drilling assembly comprising:

a first outer tubular;

a first top sub secured with respect to said first outer tubular;

a first bottom sub secured wit respect to said first outer tubular;

a first high density weight section mounted within said first outer tubular to supply at least a portion of said drilling weight to said drill bit, said first high density weight section comprising material with specific gravity greater than 10.0, said first high density weight section being slidably mounted with respect to said first outer tubular to permit axial movement of said first high density weight section with respect to said first outer tubular, said first top sub and said first bottom sub.

10. The drilling assembly of claim 9, wherein said first high density weight section comprises a tungsten compound containing no cobalt.

11. The drilling assembly of claim 9, wherein said first high density weight section is mounted adjacent said first outer tubular such that an annulus is formed therebetween.

12. The drilling assembly of claim 11, further comprising a centralizer positioned within said annulus to prevent radial movement of said first high density weight section.

13. The drilling assembly of claim 9, further comprising:

a second outer tubutar, said second outer tubular being securable with respect to said first bottom sub;

a second high density weight section comprising material with a specific gravity greater than 10.0, said second high density weight section being slidably mounted to permit axial movement with respect to said second outer tubular; and a weight transmission element extending through said first bottom sub and being slidable for axial movement with respect to said first bottom sub, said weight transmission element being mounted for supporting a first weight of said first high density weight section.

14. The drilling assembly of claim 13, wherein said weight transmission element is mounted to apply said first weight of said first high density weight section to said second high density weight section.

15. The drilling assembly of claim 9, wherein said drilling assembly is statically balanced.

16. The drilling assembly of claim 15, further comprising a plurality of weight elements wherein each weight element may be mounted in a selectable rotational position.

17. A drilling assembly for drilling a bore hole through an earth formation, said drilling assembly comprising a drill bit said drilling assembly being secured to a drill pipe string, said drilling assembly being operable for applying drilling weight to said drill bit said drilling assembly comprising:

a first outer tubular, said first outer tubular having an outer tubular wall thickness;

a first top sub secured with respect to said first outer tubular;

a first bottom sub secured with respect to said first outer tubular; and a first plurality of annular high density weight sections mounted inside said first outer tubular for supplying at least a portion of said drilling weight, said plurality of annular weight sections being stacked with respect to each other to provide a weight section tubular wall thickness at least 25% greater than said outer tubular wall thickness, each of said first plurality of annular high density weight sections having a specific gravity greater tan 10.0.

18. The drilling assembly of claim 17, wherein said weight section tubular wall thickness is at least 50% greater than said outer wall thickness.

19. The drilling assembly of claim 17, wherein each of said first plurality of annular high density weight sections comprises a tungsten compound containing no cobalt.

20. The drilling assembly of claim 17, further comprising a centralizer positioned between said first plurality of annular high density weight sections and said first outer tubular to prevent said radial movement of said first plurality of annular high density weight sections with respect to said first outer tubular.

21. The drilling assembly of claim 17, further comprising a first inner tubular defining a fluid flow path therethrough.

22. The drilling assembly of claim 21, further comprising a seal for fluid tight sealing between said first inner tubular and said first plurality of annular high density weight section.

23. The drilling assembly of claim 17, wherein said first annular high density weight section is mounted slidably mounted to permit axial movement of said first high density weight section with respect to said first outer tubular.

24. The drilling assembly of claim 23, further comprising:

a second outer tubular, said second outer tubular being securable with respect to said first bottom sub, a second plurality of annular high density weight sections slidably mounted within said second outer tubular to permit axial movement with respect to said second outer tubular, and a weight transmission element extending through said first bottom sub and being slidable for axial movement with respect to said first bottom sub, said weight transmission element being mounted for transferring a weight of said first plurality of annular high density weight sections to said second plurality of annular high density weight sections.

25. A drilling assembly for use in drilling a borehole, said drilling assembly comprising:

an outer tubular;

an upper sub;

a lower sub;

a tungsten alloy high density section mounted within said outer tubular, said upper sub, and said lower sub, said tungsten alloy comprising no cobalt.

26. The drilling assembly of claim 25, wherein said tungsten alloy comprises greater than ninety percent tungsten.

27. The drilling assembly of claim 26, wherein said tungsten alloy further comprises nickel, iron, and molybdenum.

28. A directional drilling bottom hole assembly for drilling a borehole section through an earth formation, said borehole section having a varying directional angle, said directional drilling bottom hole assembly comprising:

a drill bit;

a mud motor for rotating said drill bit;

a bent sub secured with respect to said mud motor;

a flexible weight section operable for applying a weight to said drill bit, said flexible weight section comprising, an outer tubular, an inner tubular, said outer and inner tubular forming a compartment therebeteween, said outer tubular and said inner tubular being bendable such for conforming to said varying directional angle, and a bendable tungsten weight section within said outer tubular and inner tubular for supplying a substantial portion of said weight to said drill bit.

29. The directional drilling bottom hole assembly of claim 28, wherein said bendable tungsten weight section further comprises a powder or tungsten slurry.

30. The directional drilling bottom bole assembly of claim 28, wherein said inner tubular and said outer tubular are comprised of nonmagnetic materials.

31. The directional drilling assembly of claim 30, wherein said bendable tungsten weight section is substantially nonmagnetic or completely nonmagnetic.

32. A drilling assembly for drilling a bore hole through an earth formation, said drilling assembly comprising:

an outer tubular, said outer tubular having an outer tubular cylindrical wall;

a stabilizer portion formed integrally to said outer tubular extending radially outwardly with respect to said outer tubular cylindrical wall;

a top sub secured with respect to said outer tubular;

a bottom sub secured with respect to said outer tubular; and an annular high density weight section mounted within said outer tubular, said annular high density weight section comprising material with a specific gravity greater than 10.0.

33. A drilling assembly for drilling a bore hole through an earth formation, a drill bit secured with respect to said drilling assembly, said drilling assembly being secured with respect to a drill pipe string, said drilling assembly being operable for applying drilling weight to said drill bit, said drilling assembly comprising:

a first assembly comprising:

a first outer tubular;

a first top sub secured with respect to said outer tubular;

a first bottom sub secured with respect to said outer tubular;

a first annular high density weight section slidably mounted within said first outer tubular, said first annular high density weight section comprising material with a specific gravity greater than 10.0;

a second assembly comprising:

a second outer tubular;

a second top sub secured with respect to said second outer tubular;

a second bottom sub secured with respect to said second outer tubular;

a second annular high density weight section slidably mounted within said second outer tubular, said second annular high density weight section comprising material with a specific gravity greater than 10.0; and a threaded connection between said first assembly and said second assembly.

34. The drilling assembly of claim 33, further comprising a weight transfer assembly slidably mounted within said threaded connection for applying a weight of said first annular high density weight section to said a second annular high density weight section.

35. The drilling assembly of claim 34, wherein said weight transfer assembly comprises one or more tubulars.

36. A drilling assembly for connection within a drilling a well bore through an earth formation with a drill bit, said drilling assembly comprising:

a drill pipe string;

a bottom hole assembly comprising a plurality of weight sections secured to a drilling bit wherein said plurality of weight sections are operable for supplying weight to said drilling bit during drilling; and a transition element between said drill pipe string and said bottom hole assembly, said transition element comprising:

an outer tubular, an inner tubular; and an annular high density weight section comprising tungsten affixed with respect to said outer tubular to thereby absorb vibrations produced within said bottom hole assembly.

37. A drilling assembly in a drill string for drilling an earth formation, said drilling assembly being operable for applying a substantially continuous force on a drill bit during drilling operations to thereby maintain said drill bit in contact with said earth formation, said drilling assembly comprising:

a first outer tubular;

a first force transfer member axially mounted within said first outer tubular and being axially moveable with respect to said first outer tubular;

a first treaded connector secured with respect to said first outer tubular;

a first treaded connector force transfer member mounted for axial movement within and extending through said first threaded connector, said first threaded connector force transfer member being mechanically connected to said first force transfer member for transferring a force through said first threaded connector for application to said drill bit such tat said force comprises at least a portion of said substantially continuous force on said drill bit.

38. The drilling assembly of claim 37, wherein said first transfer member comprises an annular weight section having a specific gravity greater than 10.0, said annular weight section creating at least a portion of said force for transfer through said threaded connector by said first threaded connector force transfer member.

39. The drilling assembly of claim 38, further comprising:

a second outer tubular secured with respect to said first threaded connector so as to be positioned closer to said drill bit within said drilling assembly, and a second force transfer member axially mounted within said second outer tubular and being axially moveable with respect to said second outer tubular, said second force transfer member being mechanically connected to said first force transfer member and said first threaded connector force transfer member for receiving said force.

40. The drilling assembly of claim 39, further comprising a second threaded connector secured with respect to said second outer tubular, and a second threaded connector force transfer member mounted for axial movement within and extending through said second threaded connector, said second threaded connector force transfer member being mechanically connected to said second force transfer member for transferring said force through said second threaded connector.

41. The drilling assembly of claim 37, wherein said first outer tubular is connectable to said drilling string so as to hang in tension while said force of said force transfer member is directed downwardly toward said drill bit.

42. The drilling assembly of claim 37, wherein said first force transfer member comprises a tubular construction and further comprises a temperature compensated centralizer for centralizing said first force transfer member within said first outer tubular.

43. A method for making a drilling assembly for drilling a borehole in an earth formation with a drill pipe string, said drill pipe string comprising a drilling assembly and a drill bit, said drilling assembly comprising:

providing a plurality of tubulars connectable together utilizing threaded connections to thereby form said drilling assembly;

providing one or more slidable force transfer members within respective of said plurality of tubulars;

providing that said one or more force transfer members are operable for transferring a force toward said bit through respective of said plurality of threaded connections such that said force is applied to said drill bit during drilling of said borehole while at the same time said respective of said plurality of tubulars are held in tension during said drilling of said borehole.

44. The method of claim 43 further comprising providing that one or more of said force transfer members are axially extendable through said respective of said plurality of threaded connections.

45. The method of claim 43 further comprising providing that said one or more force transfer members comprise tubular elements.

* * * * *

UNITED STATES PATENT AND TRADEMARK OFFICE

CERTIFICATE OF CORRECTION

PATENT NO. : 7,059,429 B2
APPLICATION NO. : 10/761892
DATED : June 13, 2006
INVENTOR(S) : Bruce L. Taylor et al.

It is certified that error appears in the above-identified patent and that said Letters Patent is hereby corrected as shown below:

Column 24, Claim 1, Line 65, delete “tabular” and replace with --tubular--.

Column 25, Claim 3, Line 25, delete “treaded” and replace with --threaded--.

Column 26, Claim 9, Line 6, insert --,-- between “bit” and “said”.

Column 26, Claim 9, Line 8, insert --,-- between “bit” and “said”.

Column 26, Claim 9, Line 13, delete “wit” and replace with --with--.

Column 26, Claim 17, Line 57, insert --,-- after “bit”.

Column 27, Claim 17, Line 9, delete “tan” and replace with --than--.

Column 29, Claim 37, Line 36, delete “tat” and replace with --that--.

Signed and Sealed this

Twenty-eighth Day of November, 2006

JON W. DUDAS
*Director of the United States Patent and Trademark Office*